US007447640B2

(12) United States Patent
Tsuji et al.

(10) Patent No.: US 7,447,640 B2
(45) Date of Patent: Nov. 4, 2008

(54) ACOUSTIC SIGNAL ENCODING METHOD AND APPARATUS, ACOUSTIC SIGNAL DECODING METHOD AND APPARATUS AND RECORDING MEDIUM

(75) Inventors: Minoru Tsuji, Chiba (JP); Shiro Suzuki, Kanagawa (JP); Keisuke Toyama, Tokyo (JP)

(73) Assignee: Sony Corporation, Tokyo (JP)

( * ) Notice: Subject to any disclaimer, the term of this patent is extended or adjusted under 35 U.S.C. 154(b) by 860 days.

(21) Appl. No.: 10/362,007

(22) PCT Filed: Jun. 11, 2002

(86) PCT No.: PCT/JP02/05809

§ 371 (c)(1),
(2), (4) Date: Feb. 18, 2003

(87) PCT Pub. No.: WO02/103682

PCT Pub. Date: Dec. 27, 2002

(65) Prior Publication Data

US 2004/0024593 A1 Feb. 5, 2004

(30) Foreign Application Priority Data

Jun. 15, 2001 (JP) ..... 2001-182384

(51) Int. Cl.
*G10L 21/00* (2006.01)
*G10L 21/02* (2006.01)

(52) U.S. Cl. ..... 704/503; 704/226; 704/227

(58) Field of Classification Search ..... 704/226, 704/227, 503–504
See application file for complete search history.

(56) References Cited

U.S. PATENT DOCUMENTS 5,832,424 A 11/1998 Tsutsui (Continued)

FOREIGN PATENT DOCUMENTS

JP 07-168593 7/1995

(Continued)

OTHER PUBLICATIONS

Malvar, H.S., "Lapped transforms for efficient transform/subband coding," Acoustics, Speech, and Signal Processing [see also IEEE Transactions on Signal Processing], IEEE Transactions on , vol. 38, No. 6pp. 969-978, Jun. 1990□□.*

(Continued)

*Primary Examiner*—David R. Hudspeth
*Assistant Examiner*—Justin W Rider
(74) *Attorney, Agent, or Firm*—Sonnenschein Nath & Rosenthal LLP

(57) ABSTRACT

In an acoustic signal encoding apparatus (100), a tonal noise verification unit (110) verifies whether the input acoustic time-domain signals are tonal or noisy. If the input acoustic time-domain signals are tonal, tonal component signals are extracted by a tonal component extraction unit (121), and tonal component parameters are normalized and quantized in a normalization/quantization unit (122). The residual time-domain signals, obtained on extracting the tonal component signals from the acoustic time-domain signals, are transformed by an orthogonal transforming unit (131) into the spectral information, which spectral information is normalized and quantized by a normalization/quantization unit (132). A code string generating unit (140) generates a code string from the quantized tonal component parameters and the quantized residual component spectral information.

33 Claims, 18 Drawing Sheets

U.S. PATENT DOCUMENTS

| | | | | |
|---|---|---|---|---|
| 5,886,276 | A | 3/1999 | Levine | |
| 6,061,649 | A * | 5/2000 | Oikawa et al. | 704/226 |
| 6,064,954 | A * | 5/2000 | Cohen et al. | 704/207 |
| 6,078,880 | A * | 6/2000 | Zinser et al. | 704/208 |
| 6,266,644 | B1 | 7/2001 | Levine | |
| 6,654,723 | B1 | 11/2003 | Oomen et al. | |

FOREIGN PATENT DOCUMENTS

| | | |
|---|---|---|
| JP | 07-295594 | 11/1995 |
| JP | 07-336231 | 12/1995 |
| JP | 07-336233 | 12/1995 |
| JP | 07-336234 | 12/1995 |
| JP | 09-34493 | 2/1997 |
| JP | 09-101799 | 4/1997 |
| JP | 2000-338998 | 12/2000 |
| JP | 2001-7704 | 1/2001 |
| WO | WO 94/28633 | 12/1994 |
| WO | WO 95/12920 | 5/1995 |
| WO | WO 95/34956 | 12/1995 |

OTHER PUBLICATIONS

Working Draft of ISO/IE 14496-3 MPEG4 Audio V3.0—(Part 1 and Part 2 only); International Organization for Standardization; ISO/IECJTC1/SC29/WG11—Coding of Moving Pictures and Audio; Apr. 1997; Part 1—pp. 1-29—Master document; Part 2—pp. 1-29+Annex A—1-15; Annex B 16-18.

* cited by examiner

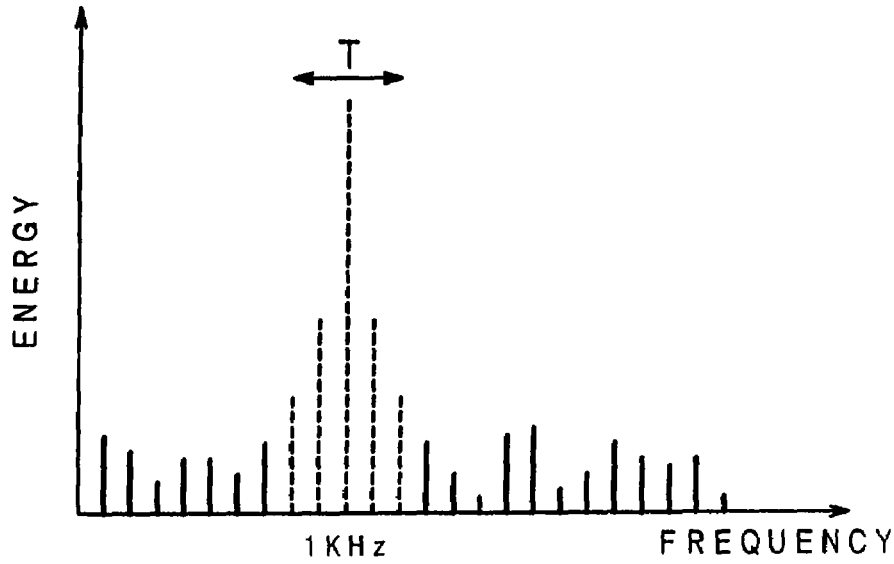
FIG. 1A – PRIOR ART
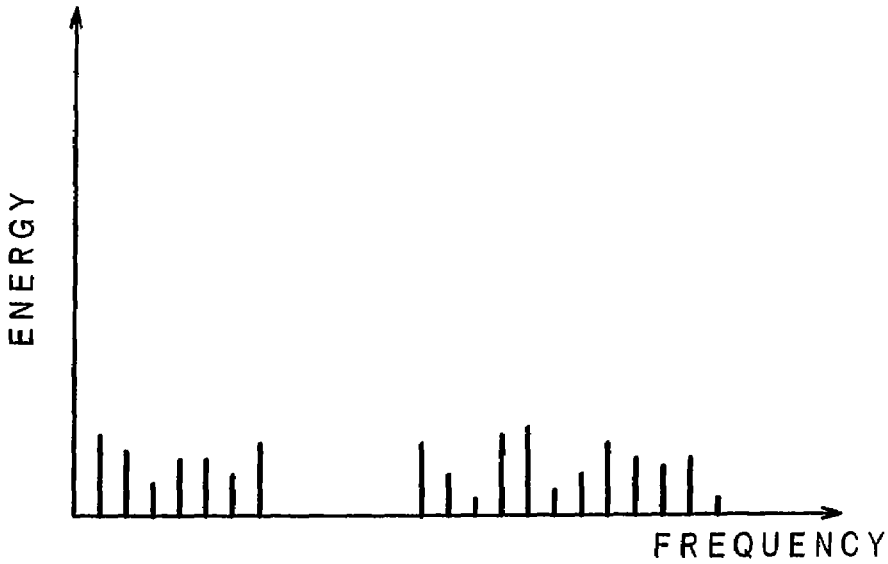
FIG. 1B – PRIOR ART

| NUMBER OF EXTRACTED PURE SOUND SAMPLES | | | N |
|---|---|---|---|
| n | FREQUENCY | sin TERM AMPLITUDE | cos TERM AMPLITUDE |
| 1 | $f_1$ | $S_1$ | $C_1$ |
| 2 | $f_2$ | $S_2$ | $C_2$ |
| 3 | $f_3$ | $S_3$ | $C_3$ |
| : | : | : | : |
| N | $f_N$ | $S_N$ | $C_N$ |

$$ES(t)=\sum_{n=0}^{N}\{S_n \sin(2\pi f_n t)+C_n \cos(2\pi f_n t)\}$$

FIG.9A

| NUMBER OF EXTRACTED PURE SOUND SAMPLES | | | N |
|---|---|---|---|
| n | FREQUENCY | AMPLITUDE | PHASE |
| 1 | $f_1$ | $A_1$ | $P_1$ |
| 2 | $f_2$ | $A_2$ | $P_2$ |
| 3 | $f_3$ | $A_3$ | $P_3$ |
| : | : | : | : |
| N | $f_N$ | $A_N$ | $P_N$ |

$$ES(t)=\sum_{n=0}^{N}\{A_n \sin(2\pi f_n t+P_n)\}$$

FIG.9B

ACOUSTIC SIGNAL ENCODING METHOD AND APPARATUS, ACOUSTIC SIGNAL DECODING METHOD AND APPARATUS AND RECORDING MEDIUM

TECHNICAL FIELD

The present invention relates to an acoustic signal encoding method and apparatus, and an acoustic signal decoding method and apparatus, in which acoustic signals are encoded and transmitted or recorded on a recording medium or the encoded acoustic signals are received or reproduced and decoded on a decoding side. This invention also relates to an acoustic signal encoding program, an acoustic signal decoding program and to a recording medium having recorded thereon a code string encoded by the acoustic signal encoding apparatus.

BACKGROUND ART

A variety of techniques exist for high efficiency encoding of digital audio signals or speech signals. Examples of these techniques include a sub-band coding (SBC) of splitting e.g., time-domain audio signals into plural frequency bands, and encoding the signals from one frequency band to another, without blocking the time-domain signals, as a non-blocking frequency band splitting system, and a blocking frequency band splitting system, or transform encoding, of converting time-domain signals by an orthogonal transform into frequency-domain signals, which frequency-domain signals are encoded from one frequency band to another. There is also a technique of high efficiency encoding consisting in the combination of the sub-band coding and transform coding. In this case, the time-domain signals are divided into plural frequency bands by sub-band coding, and the resulting band-based signals are orthogonal-transformed into signals in the frequency domain, which signals are then encoded from one frequency band to another.

There are known techniques for orthogonal transform including the technique of dividing the digital input audio signals into blocks of a predetermined time duration, by way of blocking, and processing the resulting blocks using a Discrete Fourier Transform (DFT), discrete cosine transform (DCT) or modified DCT (MDCT) to convert the signals from the time axis to the frequency axis. Discussions of a MDCT may be found in J. P. Princen and A. B. Bradley, Subband/Transform Coding Using Filter Bank Designs Based on Time Domain Aliasing Cancellation, ICASSP, 1987, Univ. of Surrey Royal Melbourne Inst. of Tech.

By quantizing the signals, divided from band to band, using a filter or orthogonal transform, it is possible to control the band susceptible to quantization noise and, by exploiting such properties as masking effect, it is possible to achieve psychoacoustically more efficient encoding. If, prior to quantization, the signal components of the respective bands are normalized using the maximum absolute value of the signal components of each band, the encoding efficiency may be improved further.

In quantizing the frequency components, resulting from the division of the frequency spectrum, it is known to divide the frequency spectrum into widths which take characteristics of the human acoustic system into account. That is, audio signals are divided into plural bands, such as 32 bands, in accordance with band widths increasing with increasing frequency. In encoding the band-based data, bits are allocated fixedly or adaptively from band to band. When applying adaptive bit allocation to coefficient data resulting from MDCT, the MDCT coefficient data are encoded with an adaptively allocated number of bits from one frequency band resulting from the block-based MDCT to another.

It should be noted that, in orthogonal transform encoding and decoding of time-domain acoustic signals, the noise contained in tonal acoustic signals, the energy of which is concentrated in a specified frequency, is extremely harsh to the ear and hence may prove to be psychoacoustically highly objectionable. For this reason, a sufficient number of bits need to be used for encoding the tonal components. However, if the quantization step is determined fixedly from one band to another, as described above, the encoding efficiency is lowered because the bits are allocated uniformly to the totality of spectral components in an encoding unit containing the tonal components.

For coping with this deficiency, there is proposed in for example the International Patent Publication WO94/28633 or Japanese Laying-Open Patent Publication 7-168593 a technique in which the spectral components are divided into tonal and non-tonal components and finer quantization steps are used only for the tonal components.

In this technique, the spectral components with a locally high energy level, that is tonal components T, are removed from the spectrum on the frequency axis as shown in FIG. 1A. The spectrum of noisy components, freed of tonal components, is shown in FIG. 1B. The tonal and noisy components are quantized using sufficient optimum quantization steps.

However, in orthogonal transform techniques, such as MDCT, it is presupposed that the waveform in a domain being analyzed is repeated periodically outside the domain being analyzed. Consequently, the frequency components which really do not exist are observed. For example, if a sine wave of a certain frequency is input, and orthogonal-transformed by MDCT, the resulting spectrum covers not only the inherent frequency but also the ambient frequency, as shown in FIG. 1A. Thus, if the sine wave is to be represented to high accuracy, not only the inherent sole frequency but also plural spectral components neighboring to the inherent frequency on the frequency axis need to be quantized with sufficient quantization steps, even though it is only being attempted by the above technique to quantize only the tonal components with high accuracy as shown in FIG. 1A. As a result, more bits are needed, thus lowering the encoding efficiency.

DISCLOSURE OF THE INVENTION

In view of the above depicted status of the art, it is an object of the present invention to provide an acoustic signal encoding method and apparatus, an acoustic signal decoding method and apparatus, an acoustic signal encoding program, an acoustic signal decoding program and a recording medium having recorded thereon a code string encoded by the acoustic signal encoding apparatus, whereby it is possible to prevent the encoding efficiency from being lowered due to a tonal component existing at a localized frequency.

An acoustic signal encoding method for encoding acoustic time-domain signals according to the present invention includes a tonal component encoding step of extracting tonal component signals from the acoustic time-domain signals and encoding the so extracted tonal component signals, and a residual component encoding step of encoding residual time-domain signals obtained on extracting the tonal component signals from the acoustic time-domain signals by the tonal component encoding step.

With this acoustic signal encoding method, tonal component signals are extracted from the acoustic time-domain signals and the tonal component signals as well as residual time-domain signals freed of the tonal component signals on extraction for the acoustic time-domain signals are encoded.

An acoustic signal decoding method for decoding acoustic signals in which tonal component signals are extracted from acoustic time-domain signals and encoded, and in which a code string obtained on encoding residual time-domain signals corresponding to the acoustic time-domain signals freed on extraction of the tonal component signals is input and decoded, according to the present invention, includes a code string resolving step of resolving the code string, a tonal component decoding step of decoding the tonal component time-domain signals in accordance with the tonal component information obtained by the code string resolving step, a residual component decoding step of decoding residual component time-domain signals in accordance with the residual component information obtained by the code string resolving step, and a summation step of summing the tonal component time-domain signals obtained by the tonal component decoding step to the residual component time-domain signals obtained by the residual component decoding step to restore the acoustic time-domain signals.

With this acoustic signal decoding method, a code string obtained on extraction of tonal component signals from the acoustic time-domain signals and on encoding the tonal component signals as well as residual time-domain signals freed of the tonal component signals on extraction from the acoustic time-domain signals is decoded to restore acoustic time-domain signals.

An acoustic signal encoding method for encoding acoustic time-domain signals according to the present invention includes a frequency band splitting step of splitting the acoustic time-domain signals into a plurality of frequency bands, a tonal component encoding step of extracting tonal component signals from the acoustic time-domain signals of at least one frequency band and encoding the so extracted tonal component signals, and a residual component encoding step of encoding residual time-domain signals freed on extraction of the tonal component by the tonal component encoding step from the acoustic time-domain signals of at least one frequency range.

With this acoustic signal encoding method, tonal component signals are extracted from the acoustic time-domain signals for at least one of plural frequency bands into which the frequency spectrum of the acoustic time-domain signals is split, and the residual time-domain signals, obtained on extracting the tonal component signals from the acoustic time-domain signals, are encoded.

An acoustic signal decoding method in which acoustic time-domain signals are split into a plurality of frequency bands, tonal component signals are extracted from the acoustic time-domain signals in at least one frequency band and encoded, a code string, obtained on encoding residual time-domain signals, obtained in turn on extracting the tonal component signals from the acoustic time-domain signals of at least one frequency band, is input, and in which the code string is decoded, according to the present invention, includes a code string resolving step of resolving the code string, a tonal component decoding step of synthesizing, for the at least one frequency band, tonal component time-domain signals in accordance with the residual component information obtained by the code string resolving step, a residual component decoding step of generating, for the at least one frequency band, residual component time-domain signals in accordance with the residual component information obtained by the code string resolving step, a summation step of summing the tonal component time-domain signals obtained by the tonal component decoding step to the residual component time-domain signals obtained by the residual component decoding step, and a band synthesizing step of band-synthesizing decoded signals for each band to restore the acoustic time-domain signals.

With this acoustic signal decoding method, tonal component signals are extracted from the acoustic time-domain signals for at least one frequency band of the acoustic time-domain signals split into plural frequency bands, and the residual time-domain signals, obtained on extracting tonal component signals from the acoustic time-domain signals, are encoded to form a code string, which is then decoded to restore acoustic time-domain signals.

An acoustic signal encoding method for encoding acoustic signals according to the present invention includes a first acoustic signal encoding step of encoding the acoustic time-domain signals by a first encoding method including a tonal component encoding step of extracting tonal component signals from the acoustic time-domain signals and encoding the tonal component signals, a residual component encoding step of encoding residual signals obtained on extracting the tonal component signals from the acoustic time-domain signals by the tonal component encoding step, and a code string generating step of generating a code string from the information obtained by the tonal component encoding step and the information obtained from the residual component encoding step, a second acoustic signal encoding step of encoding the acoustic time-domain signals by a second encoding method, and an encoding efficiency decision step of comparing the encoding efficiency of the first acoustic signal encoding step to that of the second acoustic signal encoding step to select a code string with a better encoding efficiency.

With this acoustic signal encoding method, a code string obtained by the first acoustic signal encoding process of encoding the acoustic time-domain signals by a first encoding method of extracting tonal component signals from the acoustic time-domain signals, and encoding the residual time-domain signals, obtained on extracting tonal component signals from the acoustic time-domain signals, or a code string obtained by a second encoding process of encoding the acoustic time-domain signals by a second encoding method, whichever has a higher encoding efficiency, is selected.

An acoustic signal decoding method for decoding a code string which is selectively input in such a manner that a code string encoded by a first acoustic signal encoding step or a code string encoded by a second acoustic signal encoding step, whichever is higher in encoding efficiency, is selectively input and decoded, the first acoustic signal encoding step being such a step in which the acoustic signals are encoded by a first encoding method comprising generating a code string from the information obtained on extracting tonal component signals from acoustic time-domain signals and on encoding the tonal component signals and from the information obtained on encoding residual signals obtained on extracting the tonal component signals from the acoustic time-domain signals, the second acoustic signal encoding step being such a step in which the acoustic signals are encoded by a second encoding method, according to the present invention, is such a method wherein, if the code string resulting from encoding in the first acoustic signal encoding step is input, the acoustic time-domain signals are restored by a first acoustic signal decoding step including a code string resolving sub-step of resolving the code string into the tonal component information and the residual component information, a tonal component decoding step of generating the tonal component time-domain signals in accordance with the tonal component information obtained in the code string resolving sub-step, a residual component decoding step of generating residual component time-domain signals in accordance with the residual component information obtained in the code string resolving sub-step and a summation sub-step of summing the tonal component time-domain signals to the residual component time-domain signals, and wherein, if the code string obtained on encoding in the second acoustic signal encoding step is input, the acoustic time-domain signals are restored by a second acoustic signal decoding sub-step corresponding to the second acoustic signal encoding step.

With this acoustic signal decoding apparatus, a code string obtained by a first acoustic signal encoding method of encoding the acoustic time-domain signals by a first encoding method of extracting tonal component signals from the acoustic time-domain signals, and encoding the residual time-domain signals, obtained on extracting tonal component signals from the acoustic time-domain signals, or a code string obtained by a second encoding process of encoding the acoustic time-domain signals by a second encoding method, whichever has a higher encoding efficiency, is input and decoded by an operation which is the counterpart of the operation performed on the side encoder.

An acoustic signal encoding apparatus for encoding acoustic time-domain signals, according to the present invention, includes tonal component encoding means for extracting tonal component signals from the time-domain signals and encoding the so extracted signals, and residual component encoding means for encoding residual time-domain signals, freed on extraction of the tonal component information from the acoustic time-domain signals by the tonal component encoding means.

With this acoustic signal encoding apparatus, the tonal component signals are extracted from the acoustic time-domain signals and the tonal component signals as well as the residual time-domain signals freed of the tonal component signals on extraction by the tonal component encoding means from the acoustic time-domain signals are encoded.

An acoustic signal decoding apparatus in which a code string resulting from extracting tonal component signals from acoustic time-domain signals, encoding the tonal component signals and from encoding residual time-domain signals corresponding to the acoustic time-domain signals freed on extraction of the tonal component signals, is input and decoded, according to the present invention, includes code string resolving means for resolving the code string, tonal component decoding means for decoding the tonal component time-domain signals in accordance with the tonal component information obtained by the code string resolving means, residual component decoding means for decoding the residual time-domain signals in accordance with the residual component information obtained by the code string resolving means, and summation means for summing the tonal component time-domain signals obtained from the tonal component decoding means and the residual component time-domain signals obtained from the residual component decoding means to restore the acoustic time-domain signals.

With this acoustic signal decoding apparatus, a code string obtained on extracting the tonal component signals from the acoustic time-domain signals and on encoding the tonal component signals as well as the residual time-domain signals freed of the tonal component signals on extraction by the tonal component encoding means from the acoustic time-domain signals is decoded to restore the acoustic time-domain signals.

A computer-controllable recording medium, having recorded thereon an acoustic signal encoding program configured for encoding acoustic time-domain signals, according to the present invention, is such a recording medium in which the acoustic signal encoding program includes a tonal component encoding step of extracting tonal component signals from the time-domain signals and encoding the so extracted signals, and a residual component encoding step of encoding residual time-domain signals, freed on extraction of the tonal component signals from the acoustic time-domain signals by the tonal component encoding step.

On this recording medium, there is recorded an acoustic signal encoding program of extracting the tonal component signals from the acoustic time-domain signals and on encoding the tonal component signals as well as the residual time-domain signals freed of the tonal component signals on extraction by the tonal component encoding means from the acoustic time-domain signals.

A computer-controllable recording medium, having recorded thereon an acoustic signal encoding program of encoding acoustic time-domain signals, according to the present invention, is such a recording medium in which the acoustic signal encoding program includes a code string resolving step of resolving the code string, a tonal component decoding step of decoding the tonal component time-domain signals in accordance with the tonal component information obtained by the code string resolving step, a residual component decoding step of decoding the residual time-domain signals in accordance with the residual component information obtained by the code string resolving step, and a summation step of summing the tonal component time-domain signals obtained from the tonal component decoding step and the residual component time-domain signals obtained from the residual component decoding step to restore the acoustic time-domain signals.

On this recording medium, there is recorded an acoustic signal decoding program of decoding a code string obtained on extracting the tonal component signals from the acoustic time-domain signals and on encoding the tonal component signals as well as the residual time-domain signals freed of the tonal component signals on extraction by the tonal component encoding means from the acoustic time-domain signals to restore the acoustic time-domain signals.

A recording medium according to the present invention has recorded thereon a code string obtained on extracting tonal component signals from acoustic time-domain signals, encoding the tonal component signals and on encoding residual time-domain signals corresponding to the acoustic time-domain signals freed on extraction of the tonal component signals from the acoustic time-domain signals.

Other objects, features and advantages of the present invention will become more apparent from reading the embodiments of the present invention as shown in the drawings.

BRIEF DESCRIPTION OF THE DRAWINGS

FIGS. 1A and 1B illustrate a conventional technique of extracting a tonal component, FIG. 1A illustrating the spectrum prior to removal of the tonal component and FIG. 1B illustrating the spectrum of noisy components subsequent to removal of the tonal component.

FIGS. 9A and 9B illustrate parameters of a waveform of a pure sound, FIG. 9A showing an example of using the frequency and the amplitudes of sine and cosine waves and FIG. 9B showing an example of using the frequency, amplitudes and the phase.

BEST MODE FOR CARRYING OUT THE INVENTION

Figure 2:
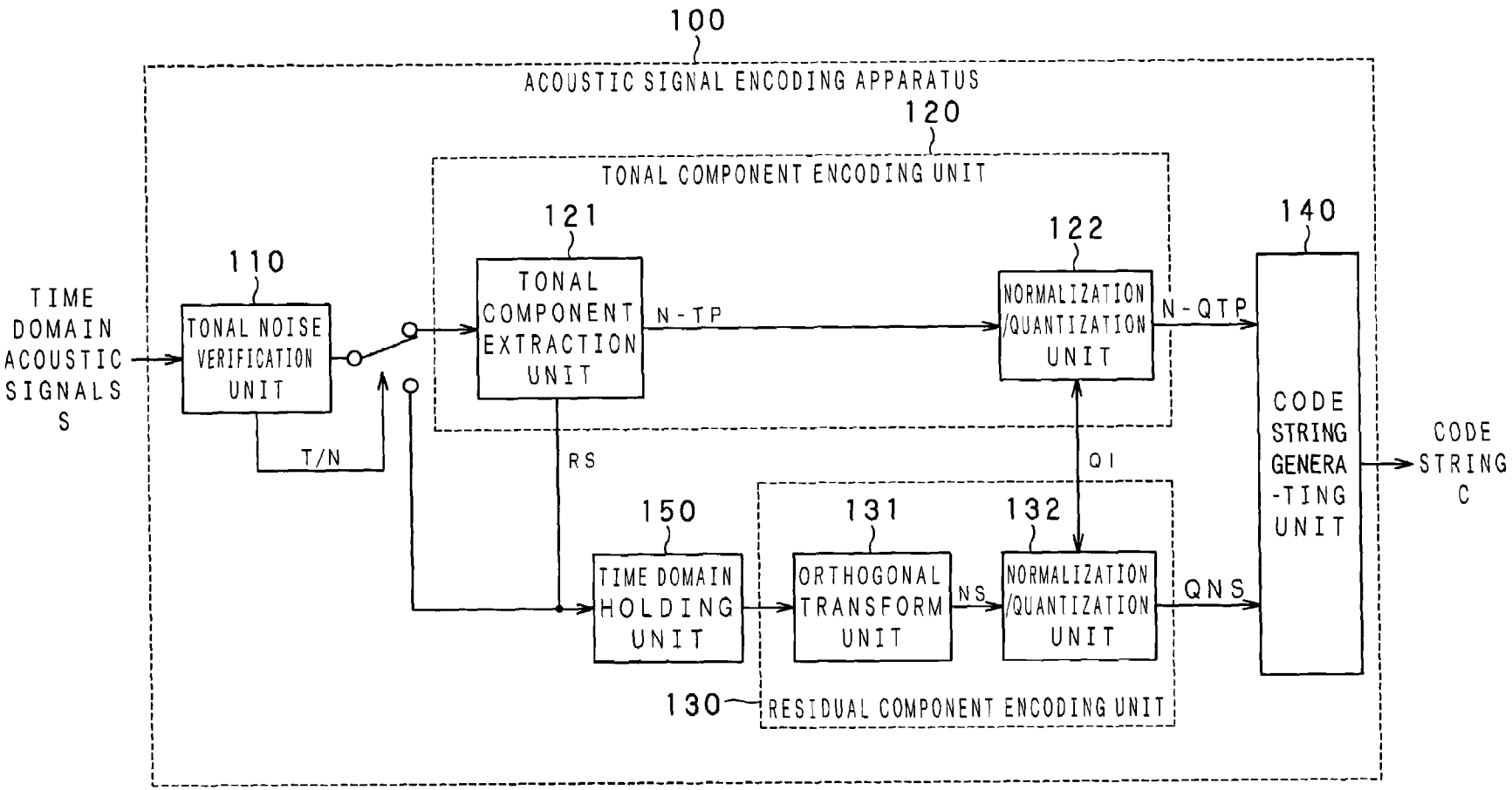
FIG. 2 illustrates a structure of an encoding apparatus for acoustic signals embodying the present invention.

Referring to the drawings, certain preferred embodiments of the present invention will be explained in detail.

An illustrative structure of the acoustic signal encoding apparatus embodying the present invention is shown in FIG. 2, in which an acoustic signal encoding apparatus 100 is shown to include a tonal noise verification unit 110, a tonal component encoding unit 120, a residual component encoding unit 130, a code string generating unit 140 and a time domain signal holding unit 150.

The tonal noise verification unit 110 verifies whether the input acoustic time-domain signals S are a tonal signal or a noise signal to output a tone/noise verification code T/N depending on the verified results to switch the downstream side processing.

The tonal component encoding unit 120 extracts a tonal component from an input signal to encode the tonal component signal, and includes a tonal component extraction unit 121 for extracting a tonal component parameter N-TP from an input signal determined to be tonal by the tonal noise verification unit 110, and a normalization/quantization unit 122 for normalizing and quantizing the tonal component parameter N-TP obtained in the tonal component extraction unit 121 to output a quantized tonal component parameter N-QTP.

The residual component encoding unit 130 encodes residual time-domain signals RS, resulting from extraction by the tonal component extraction unit 121 of the tonal component from the input signal determined to be tonal by the tonal noise verification unit 110, or the input signal determined to be noisy by the tonal noise verification unit 110. The residual component encoding unit 130 includes an orthogonal transform unit 131 for transforming these time-domain signals into the spectral information NS by for example modified discrete cosine transformation (MDCT), and a normalization/quantization unit 132 for normalizing and quantizing the spectral information NS, obtained by the orthogonal transform unit 131, to output the quantized spectral information QNS.

The code string generating unit 140 generates and outputs a code string C, based on the information from the tonal component encoding unit 120 and the residual component encoding unit 130.

The time domain signal holding unit 150 holds the time domain signals input to the residual component encoding unit 130. The processing in the time domain signal holding unit 150 will be explained subsequently.

Thus, the acoustic signal encoding apparatus 100 of the present embodiment switches the downstream side encoding processing techniques, from one frame to the next, depending on whether the input acoustic time domain signals are tonal or noisy. That is, the acoustic signal encoding apparatus extracts the tonal component signals of the tonal signal to encode parameters thereof, using the generalized harmonic analysis (GHA), as later explained, while encoding the residual signals, obtained on extracting the tonal signal component from the tonal signal, and the noisy signal, by orthogonal transform with for example MDCT, and subsequently encoding the transformed signals.

Figure 3A:
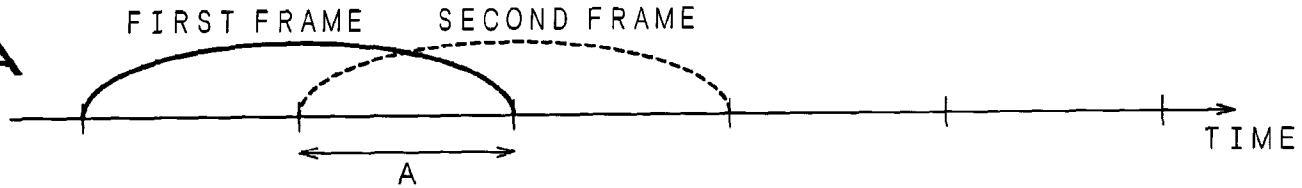
FIGS. 3A to 3C illustrate a method for smoothly linking extracted time domain signals to a directly previous frame and to the next frame, FIG. 3A showing a frame in MDCT, FIG. 3B showing a domain from which to extract the tonal component and FIG. 3C showing a window function for synthesis of the directly previous frame and the next frame.

Meanwhile, in MDCT used in general in orthogonal transform, a frame for analysis (encoding unit) needs one-half frame overlap with each of directly forward and directly backward frames, as shown in FIG. 3A. Moreover, the frame for analysis in the generalized harmonic technique analysis in tonal component encoding processing may be endowed with one-half frame overlap with the directly forward and directly backward frames, such that the extracted time domain signals can be smoothly linked to the extracted time domain signals of the directly forward and directly backward frames.

However, since there is the one-half frame overlap in the analysis frame of MDCT, as described above, the time domain signals of a domain A during analysis of the first frame must not differ from the time domain signals of the domain A during analysis of the second frame. Thus, in the residual component encoding processing, extraction of the tonal component during the domain A needs to be completed at a time point the first frame has been orthogonal transformed. Consequently, the following processing is desirably performed.

Figure 3B:
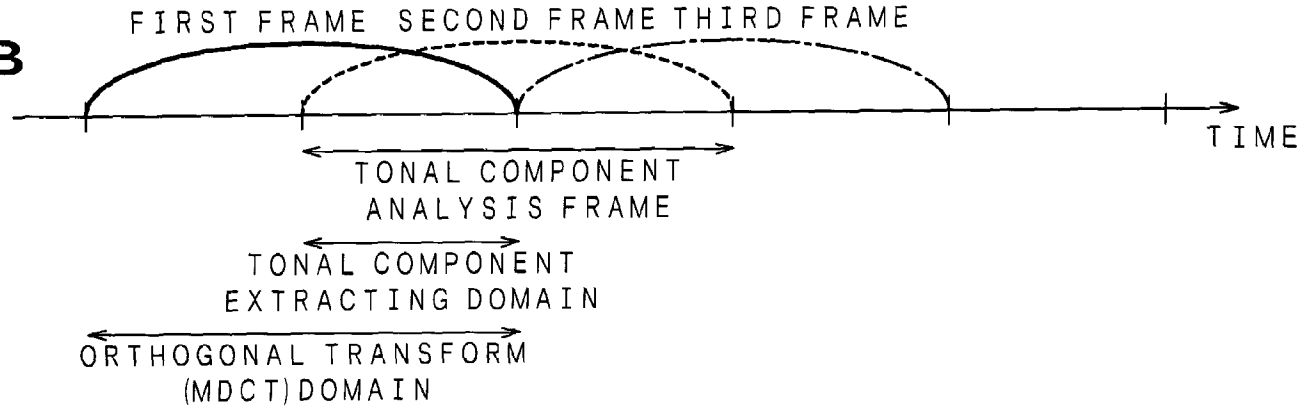

First, in encoding the tonal components, pure sound analysis is carried out by generalized harmonic analysis in a domain of the second frame shown in FIG. 3B. Subsequently, waveform extraction is carried out on the basis of the produced parameters. The domain of extraction is to be overlapped with the first frame. The analysis of pure tone by generalized harmonic analysis in a domain of the first frame has already been finished, such that waveform extraction in this domain is carried out based on the parameters obtained in each of the first and second frames. If the first frame has been determined to be noisy, waveform extraction is carried out based only on the parameters obtained in the second frame.

Figure 3C:
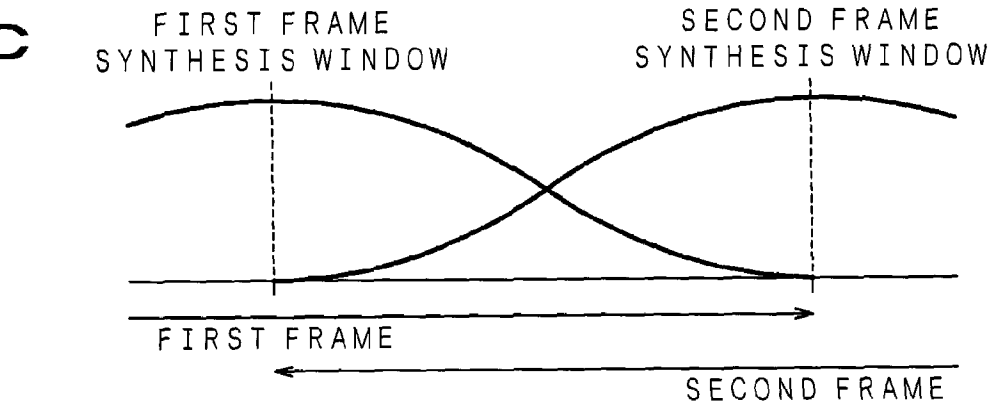

Next, the time-domain signals, extracted in each frame, are synthesized as follows: That is, the time domain signals by parameters analyzed in each frame is multiplied with a window function which on summation gives unity, such as Hanning function shown in the following equation (1):

$$Hann(t) = 0.5 \times \left(1 - \cos\frac{2\pi t}{L}\right) \tag{1}$$

where $0 \leqq t < L$, to synthesize time-domain signals in which transition from the first frame to the second frame is smooth, as shown in FIG. 3C. In the equation (1), L stands for the frame length, that is the length of one encoding unit.

The synthesized time domain signals are extracted from the input signal. Thus, residual time domain signals in the overlap domain of the first and second frames are found. These residual time domain signals serve as residual time-domain signals of the latter one-half of the first frame. The encoding of the residual components of the first frame is by forming residual time-domain signals of the first frame by the residual time-domain signals of the latter one-half of the first frame and by the residual time-domain signals of the former one-half of the first frame already held, orthogonal-transforming the residual time-domain signals of the first frame and by normalizing and quantizing the so produced spectral information. By generating the code string by the tonal component information of the first frame and the residual component information of the first frame, it is possible to synthesize the tonal components and the residual components in one frame at the time of decoding.

Meanwhile, if the first frame is the noisy signal, there lack tonal component parameters of the first frame. Consequently, the above-mentioned window function is multiplied only with the time-domain signals extracted in the second frame. The so produced time-domain signals are extracted from the input signal, with the residual time-domain signals similarly serving as residual time-domain signals of the latter one-half of the first frame.

The above enables extraction of smooth tonal component time-domain signals having no discontinuous points. Moreover, it is possible to prevent frame-to-frame non-matching in MDCT in encoding the residual components.

For carrying out the above processing, the acoustic signal encoding apparatus 100 includes the time domain signal holding unit 150 ahead of the residual component encoding unit 130, as shown in FIG. 2. This time domain signal holding unit 150 holds residual time-domain signals every one-half frame. The tonal component encoding unit 120 includes parameter holding portions 2115, 2217 and 2319, as later explained, and outputs waveform parameters and the extracted waveform information of the previous frame.

Figure 4:
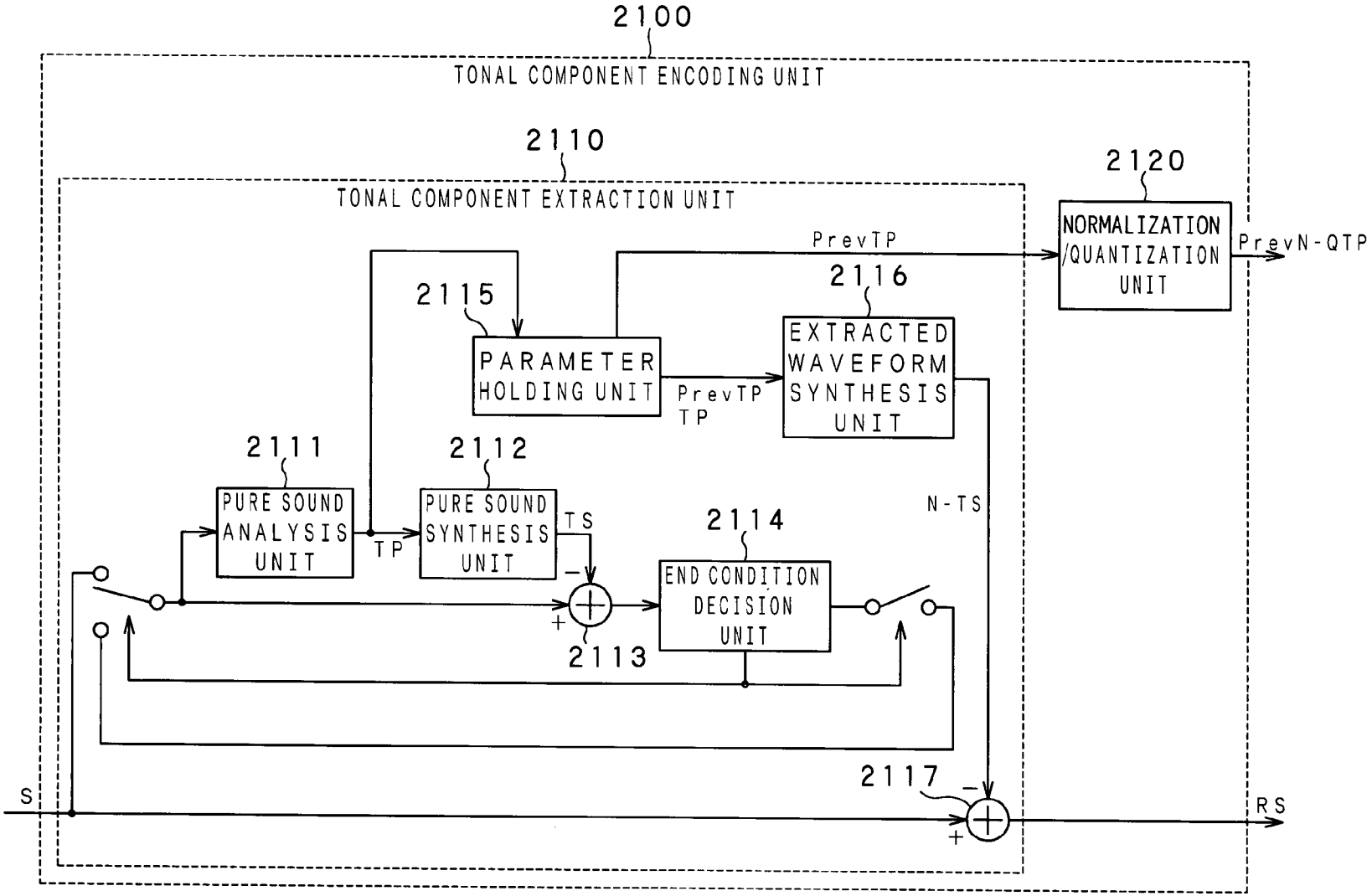
FIG. 4 illustrates a structure of a tonal component encoding unit of the encoding apparatus for acoustic signals.

The tonal component encoding unit 120, shown in FIG. 2, may specifically be configured as shown in FIG. 4. For frequency analysis in tonal component extraction, tonal component synthesis and tonal component extraction, the generalized harmonic analysis, as proposed by Wiener, is applied. This technique is such an analysis technique in which the sine wave which gives the smallest residual energy in an analysis block is extracted from the original time-domain signals, with this processing being repeated for the resulting residual signals. With this technique, frequency components can be extracted one by one in the time domain without being influenced by the analysis window. Moreover, the frequency resolution can be freely set, such that frequency analysis can be achieved more precisely than is possible with Fast Fourier transform (FFT) or MDCT.

A tonal component encoding unit 2100, shown in FIG. 4, includes a tonal component extraction unit 2110 and a normalization/quantization unit 2120. The tonal component extraction unit 2110 and the normalization/quantization unit 2120 are similar to the component extraction unit 121 and the normalization/quantization unit 122 shown in FIG. 2.

In the tonal component encoding unit 2100, a pure sound analysis unit 2111 analyzes a pure sound component, which minimizes the energy of the residual signals, from the input acoustic time-domain signals S. The pure sound analysis unit then sends the pure sound waveform parameter TP to a pure sound synthesis unit 2112 and to a parameter holding unit 2115.

The pure sound synthesis unit 2112 synthesizes a pure sound waveform time-domain signals TS of the pure sound component, analyzed by the pure sound analysis unit 2111. A subtractor 2113 extracts the pure sound waveform time-domain signals TS, synthesized by the pure sound synthesis unit 2112, from the input acoustic time-domain signals S.

An end condition decision unit 2114 checks whether or not the residual signals obtained by pure sound extraction in the subtractor 2113 meet the end condition for tonal component extraction, and effects switching for repeating pure sound extraction, with the residual signal as the next input signal for the pure sound analysis unit 2111, until the end condition is met. This end condition will be explained subsequently.

The parameter holding unit 2115 holds the pure sound waveform parameter TP of the current frame and a pure sound waveform parameter of the previous frame PrevTP to route the pure sound waveform parameter of the previous frame PrevTP to a normalization/quantization unit 2120, while routing the pure sound waveform parameter TP of the current frame and the pure sound waveform parameter of the previous frame PrevTP to an extracted waveform synthesis unit 2116.

The extracted waveform synthesis unit 2116 synthesizes the time-domain signals by the pure sound waveform parameter TP in the current frame to the time-domain signals by the pure sound waveform parameter of the previous frame PrevTP, using the aforementioned Hanning function, to generate tonal component time-domain signals N-TS for an overlap domain. A subtractor 2117 extracts the tonal component time-domain signals N-TS from the input acoustic time-domain signals S to output residual time-domain signals RS for the overlap domain. These residual time-domain signals RS are sent to and held by the time domain signal holding unit 150 shown in FIG. 2.

The normalization/quantization unit 2120 normalizes and quantizes the pure sound waveform parameter of the previous frame PrevTP, supplied from the parameter holding unit 2115, to output a quantized tonal component parameter of the previous frame PrevN-QTP.

It should be noted that the configuration shown in FIG. 4 is susceptible to quantization error in encoding the tonal component. In order to combat this, such a configuration may be used, in which the quantization error is contained in the residual time-domain signals, as shown in FIGS. 5 and 6.

Figure 5:
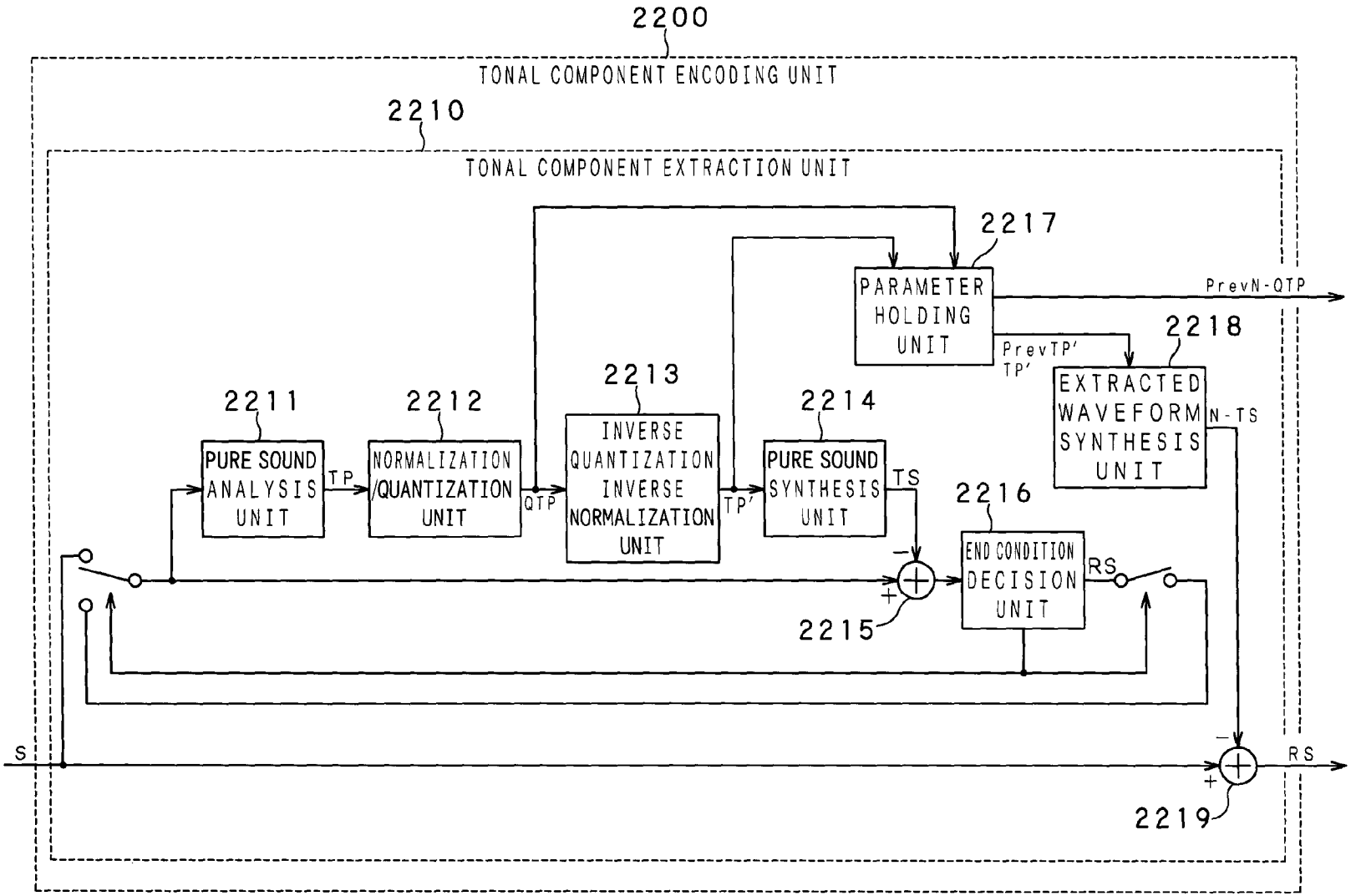
FIG. 5 illustrates a first structure of the tonal component encoding unit in which the quantization error is contained in residual time-domain signals.
Figure 6:
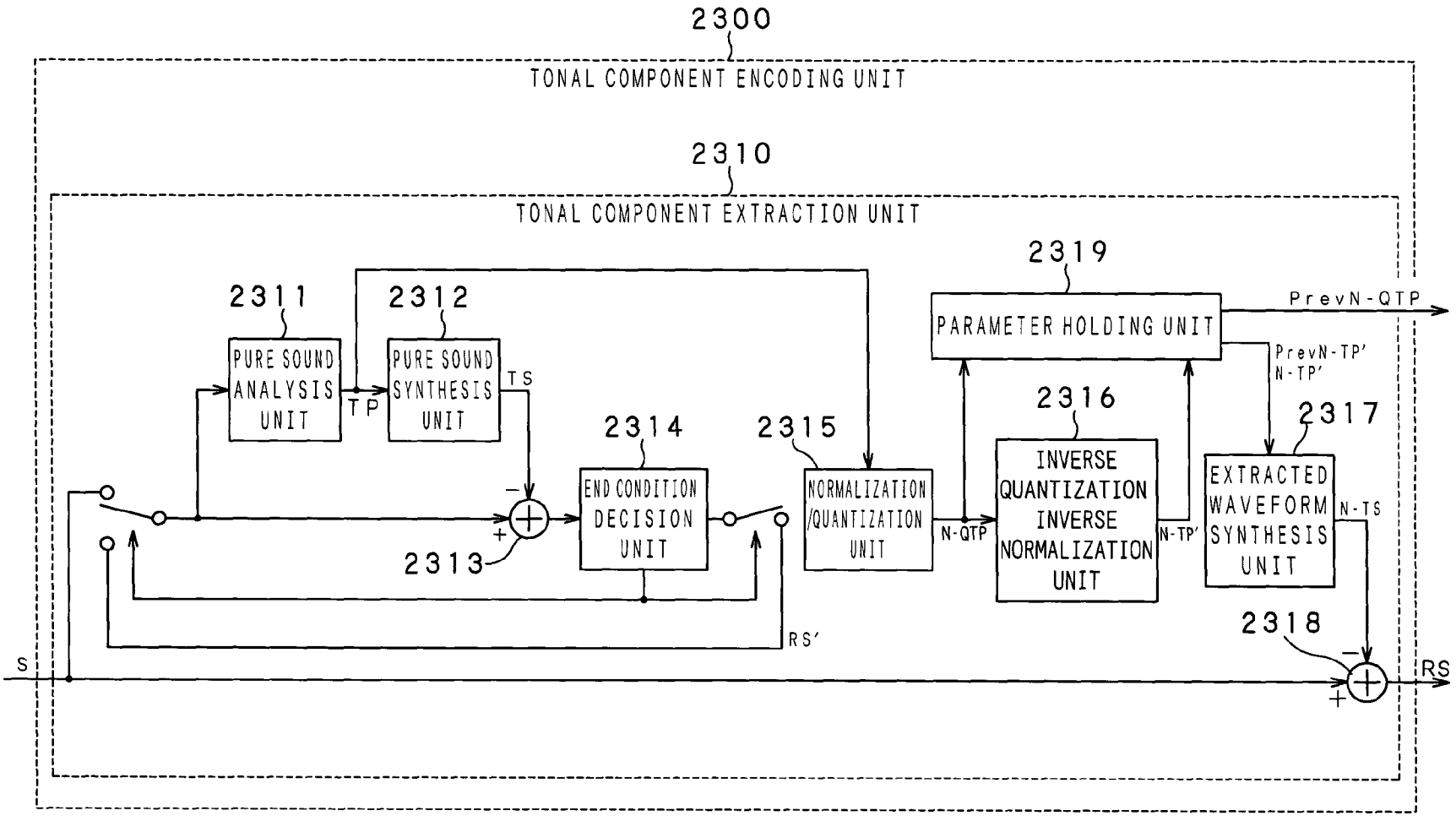
FIG. 6 illustrates a first structure of the tonal component encoding unit in which the quantization error is contained in residual time-domain signals.

As a first configuration for having the quantization error included in the residual time-domain signals, a tonal component encoding unit 2200, shown in FIG. 5, includes a normalization/quantization unit 2212 in the tonal component extraction unit 2210, for normalizing and quantizing the tonal signal information.

In the tonal component encoding unit 2200, a pure sound analysis unit 2211 analyzes a pure sound component, which minimizes the residual signals, from the input acoustic time-domain signals S, to route the pure sound waveform parameter TP to the normalization/quantization unit 2212.

The normalization/quantization unit 2212 normalizes and quantizes the pure sound waveform parameter TP, supplied from the pure sound analysis unit 2211, to send the quantized pure sound waveform parameter QTP to an inverse quantization inverse normalization unit 2213 and to a parameter holding unit 2217.

The inverse quantization inverse normalization unit 2213 inverse quantizes and inverse normalizes the quantized pure sound waveform parameter QTP to route inverse quantized pure sound waveform parameter TP' to a pure sound synthesis unit 2214 and to the parameter holding unit 2217.

The pure sound synthesis unit 2214 synthesizes the pure sound waveform time-domain signals Ts of the pure sound component, based on the inverse quantized pure sound waveform parameter TP', to extract at subtractor 2215 the pure sound waveform time-domain signals TS, synthesized by the pure sound synthesis unit 2214, from the input acoustic time-domain signals S.

An end condition decision unit 2216 checks whether or not the residual signals obtained on pure sound extraction by the subtractor 2215 meets the end condition of tonal component extraction and effects switching for repeating pure sound extraction, with the residual signal as the next input signal for the pure sound analysis unit 2211, until the end condition is met. This end condition will be explained subsequently.

The parameter holding unit 2217 holds the quantized pure sound waveform parameter QTP and an inverse quantized pure sound waveform parameter TP' to output the quantized tonal component parameter of the previous frame PrevN-QTP, while routing the inverse quantized pure sound waveform parameter TP' and the inverse quantized pure sound waveform parameter of the previous frame PrevTP' to an extracted waveform synthesis unit 2218.

The extracted waveform synthesis unit 2218 synthesizes time-domain signals by the inverse quantized pure sound waveform parameter TP' in the current frame to the time-domain signals by the inverse quantized pure sound waveform parameter of the previous frame PrevTP', using the aforementioned Harming function, to generate tonal component time-domain signals N-TS for an overlap domain. A subtractor 2219 extracts the tonal component time-domain signals N-TS from the input acoustic time-domain signals S to output residual time-domain signals RS for the overlap domain. These residual time-domain signals RS are sent to and held by the time domain signal holding unit 150 shown in FIG. 2.

As a second configuration of having the quantization error included in the residual time-domain signals, a tonal component encoding unit 2300, shown in FIG. 6, also includes a normalization/quantization unit 2315, adapted for normalizing and quantizing the information of the tonal signals, in a tonal component extraction unit 2310.

In the tonal component encoding unit 2300, a pure sound analysis unit 2311 analyzes the pure sound component, which minimizes the energy of the residual signals, from the input acoustic time-domain signals S. The pure sound analysis unit routes the pure sound waveform parameter TP to a pure sound synthesis unit 2312 and to a normalization/quantization unit 2315.

The pure sound synthesis unit 2312 synthesizes the pure sound waveform time-domain signals TS, analyzed by the pure sound analysis unit 2311, and a subtractor 2313 extracts the pure sound waveform time-domain signals TS, synthesized by the pure sound synthesis unit 2312, from the input acoustic time-domain signals S.

An end condition decision unit 2314 checks whether or not the residual signals obtained by pure sound extraction by the subtractor 2313 meets the end condition for tonal component extraction, and effects switching for repeating pure sound extraction, with the residual signal as the next input signal for the pure sound analysis unit 2311, until the end condition is met.

The normalization/quantization unit 2315 normalizes and quantizes the pure sound waveform parameter TP, supplied from the pure sound analysis unit 2311, and routes the quantized pure sound waveform parameter N-QTP to an inverse quantization inverse normalization unit 2316 and to a parameter holding unit 2319.

The inverse quantization inverse normalization unit 2316 inverse quantizes and inverse normalizes the quantized pure sound waveform parameter N-QTP to route the inverse quantized pure sound waveform parameter N-TP' to the parameter holding unit 2319.

The parameter holding unit 2319 holds the quantized pure sound waveform parameter N-QTP and the inverse quantized pure sound waveform parameter N-TP' to output the quantized tonal component parameter of the previous frame PrevN-QTP. The parameter holding unit also routes the inverse quantized pure sound waveform parameter for the current frame N-TP' and the inverse quantized pure sound waveform parameter of the previous frame PrevN-TP' to the extracted waveform synthesis unit 2317.

The extracted waveform synthesis unit 2317 synthesizes time-domain signals by the inverse quantized pure sound waveform parameter of the current frame N-TP' to the inverse quantized pure sound waveform parameter of the previous frame PrevN-TP', using for example the aforementioned Hanning function, to generate the tonal component time-domain signals N-TS for the overlap domain. A subtractor 2318 extracts the tonal component time-domain signals N-TS from the input acoustic time-domain signals S to output the residual time-domain signals RS for the overlap domain. These residual time-domain signals RS are sent to and held in the time domain signal holding unit 150 of FIG. 2.

Meanwhile, in the illustrative structure of FIG. 5, the normalization coefficient for the amplitude is fixed for a value not less than the maximum value that can be assumed. For example, if the input signal is the acoustic time-domain signals, recorded on a music Compact Disc (CD), quantization is carried out using 96 dB as the normalization coefficient. Meanwhile, the normalization coefficient is of a fixed value and hence need not be included in the code string.

Figure 7:
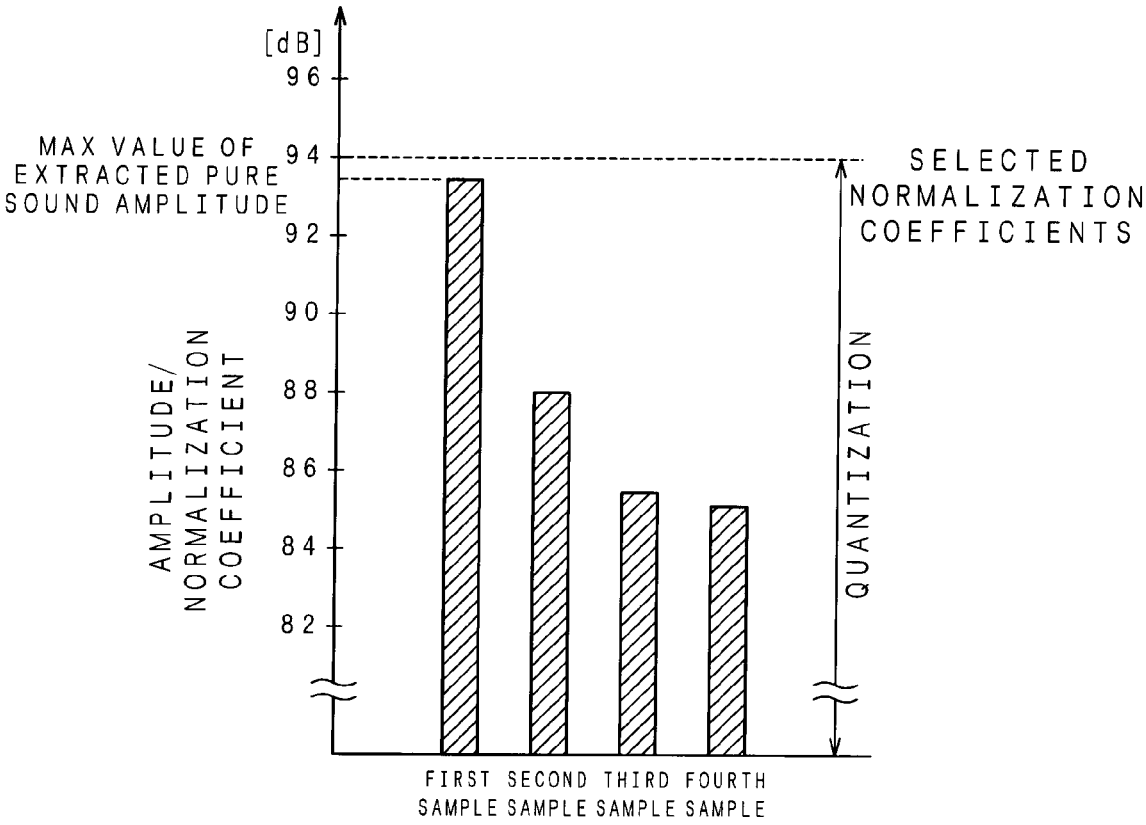
FIG. 7 illustrates an instance of determining normalization coefficients using the maximum amplitude values of extracted plural sine waves as reference.

Conversely, with the illustrative structures shown in FIGS. 4 and 6, it is possible to determine the normalization coefficient with the maximum amplitude value of the extracted plural sine waves as a reference, as shown for example in FIG. 7. That is, an optimum normalization coefficient is selected from among the plural normalization coefficients, provided at the outset, and the amplitude values of the totality of the sine waves are quantized using this normalization coefficient. In this case, the information indicating the normalization coefficient used in the quantization is included in the code string. In the case of the illustrative structures, shown in FIGS. 4 and 6, as compared to the illustrative structure of FIG. 5, quantization may be achieved to a higher accuracy, even though the quantity of bits is increased by a value corresponding to the information indicating the normalization coefficient.

Figure 8:
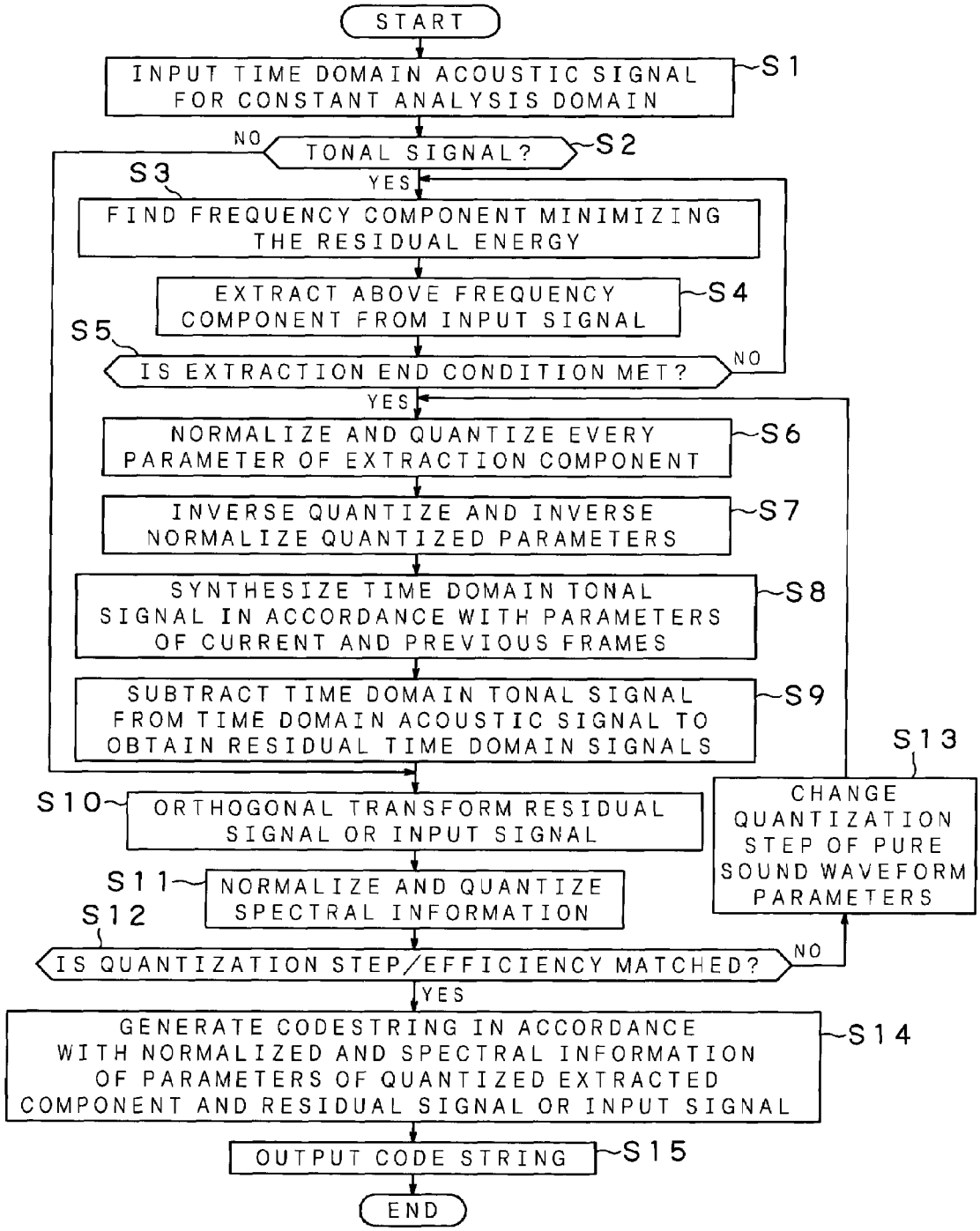
FIG. 8 is a flowchart for illustrating a sequence of operations of an acoustic signal encoding apparatus having the tonal component encoding unit of FIG. 6.

The processing by the acoustic signal encoding apparatus 100 in case the tonal component encoding unit 120 of FIG. 2 is configured as shown in FIG. 6 is now explained in detail with reference to the flowchart of FIG. 8.

First, at step S1, the acoustic time-domain signals are input for a certain preset analysis domain (number of samples).

At the next step S2, it is checked whether or not the input time-domain signals are tonal. While a variety of methods for decision may be envisaged, it may be contemplated to process e.g., the input time-domain signal x(t) with spectral analysis, such as by FFT, and to give a decision that the input signal is tonal when the average value AVE (X(k)) and the maximum value Max (X(k)) of the resulting spectrum X(k) meet the following equation (2):

$$\frac{\mathrm{Max}(X(k))}{AVE(X(k))} > TH_{tone} \tag{2}$$

that is when the ratio thereof is larger than a preset threshold $Th_{tone}$.

If it is determined at step S2 that the input signal is tonal, processing transfers to step S3. If it is determined that the input signal is noisy, processing transfers to step S10.

At step S3, such frequency component which give the smallest residual energy is found from the input time-domain signals. The residual components, when the pure sound waveform with a frequency f is extracted from the input time-domain signals $x_0(t)$, are depicted by the following equation (3):

$$RS_f(t)=x_0(t)-S_f\sin(2\pi ft)-C_f\cos(2\pi ft) \tag{3}$$

where L denotes the length of the analysis domain (number of samples).

In the above equation (3), $S_f$ and $C_f$ may be depicted by the following equations (4) and (5):

$$S_f = \frac{2}{L}\int_0^L x_0(t)\sin(2\pi ft)dt \tag{4}$$

$$C_f = \frac{2}{L}\int_0^L x_0(t)\cos(2\pi ft)dt. \tag{5}$$

In this case, the residual energy $E_f$ is given by the following equation (6):

$$E_f = \int_0^L RS_f(t)^2 dt. \tag{6}$$

The above analysis is carried out for the totality of frequencies f to find the frequency $f_1$ which will give the smallest residual energy $E_f$.

At the next step S4, the pure sound waveform of the frequency $f_1$, obtained at step S3, is extracted from the input time-domain signals $x_0(t)$ in accordance with the following equation (7):

$$x_1(t)=x_0(t)-S_{f1}\sin(2\pi ft)-C_{f1}\cos(2\pi ft) \tag{7}$$

At step S5, it is checked whether or not the end condition for extraction has been met. The end condition for extraction may be exemplified by the residual time-domain signals not being tonal signals, the energy of the residual time-domain signals having fallen by not less than a preset value from the energy of the input time-domain signals, the decreasing amount of the residual time-domain signals resulting from the pure sound extraction being not higher than a threshold value, and so forth.

If, at step S5, the end condition for extraction is not met, program reverts to step S3 where the residual time-domain signals obtained in the equation (7) are set as the next input time-domain signals $x_1(t)$. The processing as from step S3 to step S5 is repeated N times until the end condition for extraction is met. If, at step S5, the end condition for extraction is met, processing transfers to step S6.

At step S6, the N pure sound information obtained, that is the tonal component information N-TP, is normalized and quantized. The pure sound information may, for example, be the frequency $f_n$, amplitude $S_{fn}$ or amplitude $C_{fn}$ of the extracted pure sound waveform, shown in FIG. 9A, or the frequency $f_n$, amplitude $A_{fn}$ or phase $P_{fn}$, shown in FIG. 9B where $0 \leqq n < N$. The frequency $f_n$, amplitude $S_{fn}$, amplitude $C_{fn}$, amplitude $A_{fn}$ and the phase $P_{fn}$ are correlated with one another in accordance with the following equations (8) to (10):

$$S_{fn}\sin(2\pi f_n t)-C_{fn}\cos(2\pi f_1 t)=A_{fn}\sin(2\pi f_n t+P_{fn}) \quad (0 \leqq t < L) \tag{8}$$

$$A_{fn}=\sqrt{S_{fn}^2+C_{fn}^2} \tag{9}$$

$$P_{fn} = \arctan\left(\frac{C_{fn}}{S_{fn}}\right). \tag{10}$$

At the next step S7, the quantized pure sound waveform parameter N-QTP is inverse quantized and inverse normalized to obtain the inverse quantized pure sound waveform parameter N-TP'. By first normalizing and quantizing the tonal component information and subsequently inverse quantizing and inverse normalizing the component information, time-domain signals, which may be completely identified with the tonal component time-domain signals, extracted here, may be summed during the process of decoding the acoustic time-domain signals.

At the next step S8, the tonal component time-domain signals N-TS is generated in accordance with the following equation (11):

$$NTS(t) = \sum_{n=0}^{N}(S'_{fn}\sin(2\pi f_n t) + C'_{fn}\cos(2\pi f_n t)) \quad (0 \le t < L) \tag{11}$$

for each of the inverse quantized pure sound waveform parameter of the previous frame PrevN-TP' and the inverse quantized pure sound waveform parameter of the current frame N-TP'.

These tonal component time-domain signals N-TS are synthesized in the overlap domain, as described above to give the tonal component time-domain signals N-TS for the overlap domain.

At step S9, the synthesized tonal component time-domain signals N-TS is subtracted from the input time-domain signals S, as indicated by the equation (12):

$$RS(t)=S(t)-NTS(t) \quad (0 \leqq t < L) \tag{12}$$

to find the one-half-frame equivalent residual time-domain signals RS.

At the next step S10, the one frame to be now encoded is formed by one-half-frame equivalent of residual time-domain signals RS or one-half-frame equivalent of the input signal verified to be noisy at step S2 and one-half-frame equivalent of the residual time-domain signals RS already held or the one-half frame equivalent of the input signal. These one-frame signals are orthogonal-transformed with DFT or MDCT. At the next step S11, the spectral information, thus produced, is normalized and quantized.

It may be contemplated to adaptively change the precision in normalization or in quantization of the spectral information of the residual time-domain signals. In this case, it is checked at step S12 whether or not the quantization information, such as quantization steps or quantization efficiency, is in the matched state. If the quantization step or quantization efficiency of the parameters of the pure sound waveform or the spectral information of the residual time-domain signals is not matched, such that sufficient quantization steps cannot be achieved due for example to excessively fine quantization steps of the pure sound waveform parameters, the quantization step of the pure sound waveform parameters is changed at step S13. The processing then reverts to step S6. If the quantization step or the quantization efficiency is found to be matched at step S12, processing transfers to step S14.

At step S14, a code string is generated in accordance with the spectral information of the pure sound waveform parameters, residual time-domain signals or the input signal found to be noisy. At step S15, the code string is output.

The acoustic signal encoding apparatus of the present embodiment, performing the above processing, is able to extract tonal component signals from the acoustic time-domain signals in advance to perform efficient encoding on the tonal components and on the residual signals.

Figure 10:
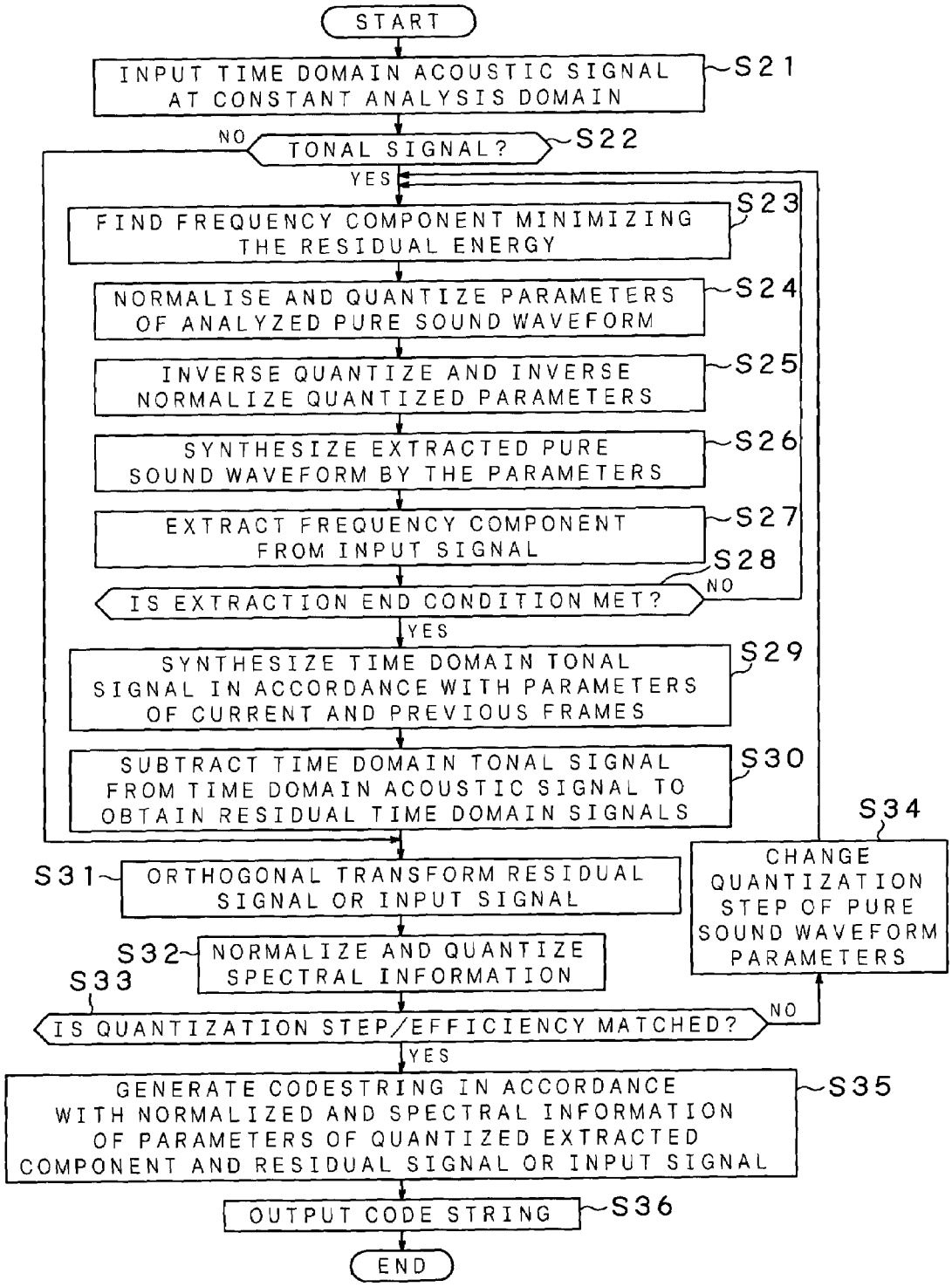
FIG. 10 is a flowchart showing a sequence of operations of an acoustic signal encoding apparatus having the tonal component encoding unit of FIG. 5.

While the processing by the acoustic signal encoding apparatus 100 in case the tonal component encoding unit 120 is configured as shown in FIG. 6 has been explained with reference to the flowchart of FIG. 8, the processing by the acoustic signal encoding apparatus 100 in case the tonal component encoding unit 120 is configured as shown in FIG. 5 is as depicted in the flowchart of FIG. 10.

At step S21 of FIG. 10, time-domain signals at a preset analysis domain (number of samples) are input.

At the next step S22, it is verified whether or not the input time-domain signals are tonal in this analysis domain. The decision technique is similar to that explained in connection with FIG. 8.

At step S23, the frequency $f_1$ which will minimize the residual frequency is found from the input time-domain signals.

At the next step S24, the pure sound waveform parameters TP are normalized and quantized. The pure sound waveform parameters may be exemplified by the frequency $f_1$, amplitude $S_{f1}$ and amplitude $C_{f1}$ of the extracted pure sound waveform, frequency $f_1$, amplitude $A_{f1}$ and phase $P_{f1}$.

At the next step S25, the quantized pure sound waveform parameter QTP is inverse quantized and inverse normalized to obtain pure sound waveform parameters TP'.

At the next step S26, the pure sound time-domain signals TS are generated, in accordance with the pure sound waveform parameters TP', by the following equation (13):

$$TS(t)=S'_{f1}\sin(2\pi f_1 t)+C'_{f1}\cos(2\pi f_1 t) \quad (13).$$

At the next step S27, the pure sound waveform of the frequency $f_1$, obtained at step S23, is extracted from the input time-domain signals $x_0(t)$, by the following equation (14):

$$x_1(t)=x_0(t)-TS(t) \quad (14).$$

At the next step S28, it is verified whether or not extraction end conditions have been met. If, at step S28, the extraction end conditions have not been met, program reverts to step S23. It is noted that the residual time-domain signals of the equation (10) become the next input time-domain signals $x_i(t)$. The processing from step S23 to step S28 is repeated N times until the extraction end conditions are met. If, at step S28, the extraction end conditions are met, processing transfers to step S29.

At step S29, the one-half frame equivalent of the tonal component time-domain signals N-TS to be extracted is synthesized in accordance with the pure sound waveform parameter of the previous frame PrevN-TP' and with the pure sound waveform parameters of the current frame TP'.

At the next step S30, the synthesized tonal component time-domain signals N-TS are subtracted from the input time-domain signals S to find the one-half frame equivalent of the residual time-domain signals RS.

At the next step S31, one frame is formed by this one-half frame equivalent of the residual time-domain signals RS or a one-half frame equivalent of the input signal found to be noisy at step S22, and by a one-half equivalent of the residual time-domain signals RS already held or a one-half frame equivalent of the input signal, and is orthogonal-transformed by DFT or MDCT. At the next step S32, the spectral information produced is normalized and quantized.

It may be contemplated to adaptively change the precision of normalization and quantization of the spectral information of the residual time-domain signals. In this case, it is verified at step S33 whether or not quantization information QI, such as quantization steps or quantization efficiency, is in a matched state. If the quantization step or quantization efficiency between the pure sound waveform parameter and the spectral information of the residual time-domain signals is not matched, as when a sufficient quantization step in the spectral information is not guaranteed due to the excessively high quantization step of the pure sound waveform parameter, the quantization step of the pure sound waveform parameters is changed at step S34. Then, program reverts to step S23. If it is found at step S33 that the quantization step or quantization efficiency is matched, processing transfers to step S35.

At step S35, a code string is generated in accordance with the spectral information of the produced pure sound waveform parameter, residual time-domain signals or the input signal found to be noisy. At step S36, the so produced code string is output.

Figure 11:
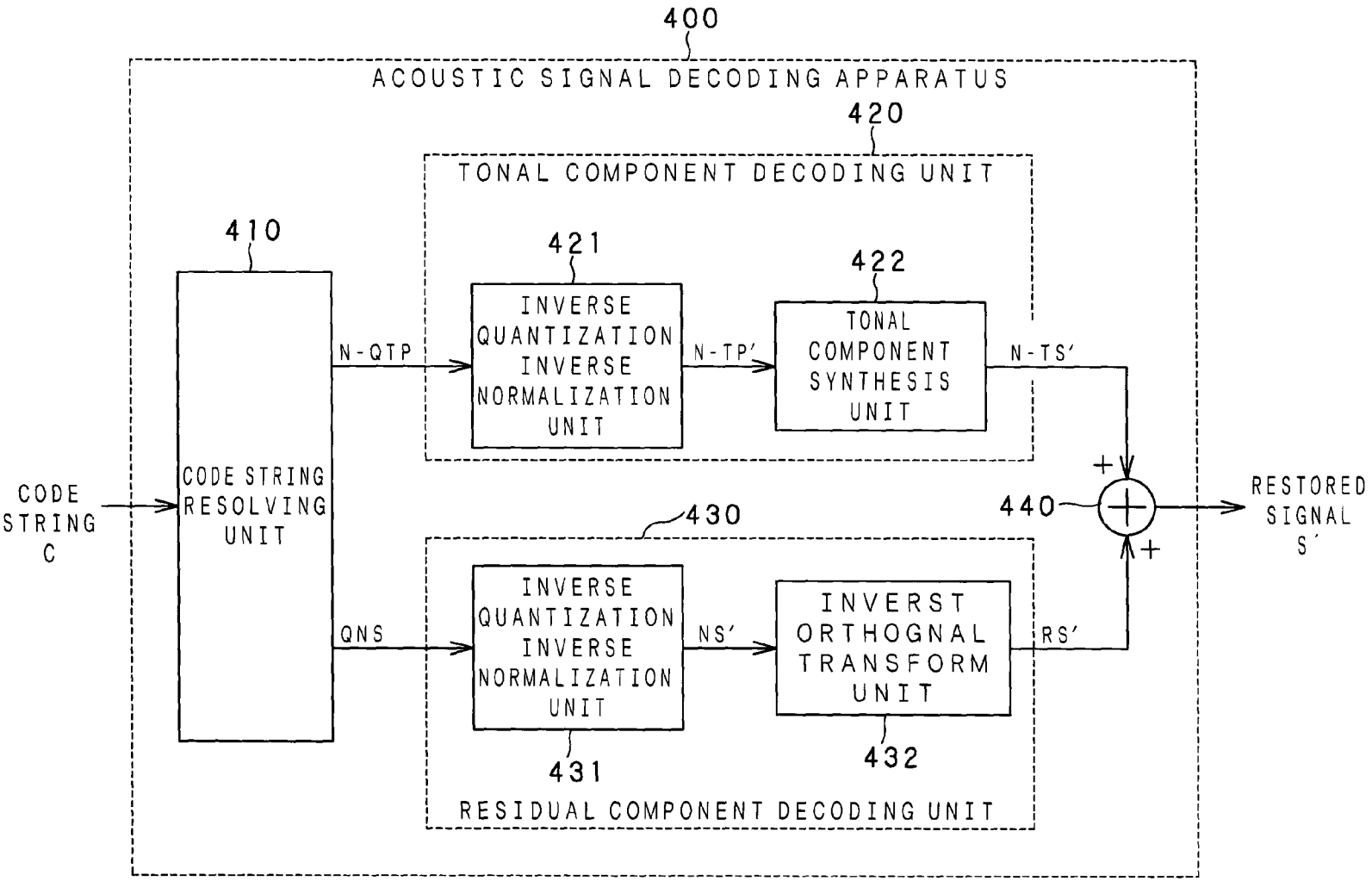
FIG. 11 illustrates a structure of an acoustic signal decoding apparatus embodying the present invention.

FIG. 11 shows a structure of an acoustic signal decoding apparatus 400 embodying the present invention. The acoustic signal decoding apparatus 400, shown in FIG. 11, includes a code string resolving unit 410, a tonal component decoding unit 420, a residual component decoding unit 430 and an adder 440.

The code string resolving unit 410 resolves the input code string into the tonal component information N-QTP and into the residual component information QNS.

The tonal component decoding unit 420, adapted for generating the tonal component time-domain signals N-TS' in accordance with the tonal component information N-QTP, includes an inverse quantization inverse normalization unit 421 for inverse quantization/inverse normalization of the quantized pure sound waveform parameter N-QTP obtained by the code string resolving unit 410, and a tonal component synthesis unit 422 for synthesizing the tonal component time-domain signals N-TS' in accordance with the tonal component parameters N-TP' obtained in the inverse quantization inverse normalization unit 421.

The residual component decoding unit 430, adapted for generating the residual component information RS' in accordance with the residual component information QNS, includes an inverse quantization inverse normalization unit 431, for inverse quantization/inverse normalization of the residual component information QNS, obtained in the code string resolving unit 410, and an inverse orthogonal transform unit 432 for inverse orthogonal transforming the spectral information NS', obtained in the inverse quantization inverse normalization unit 431, for generating the residual time-domain signals RS'.

The adder 440 synthesizes the output of the tonal component decoding unit 420 and the output of the residual component decoding unit 430 to output a restored signal S'.

Thus, the acoustic signal decoding apparatus 400 of the present embodiment resolves the input code string into the tonal component information and the residual component information to perform decoding processing accordingly.

Figure 12:
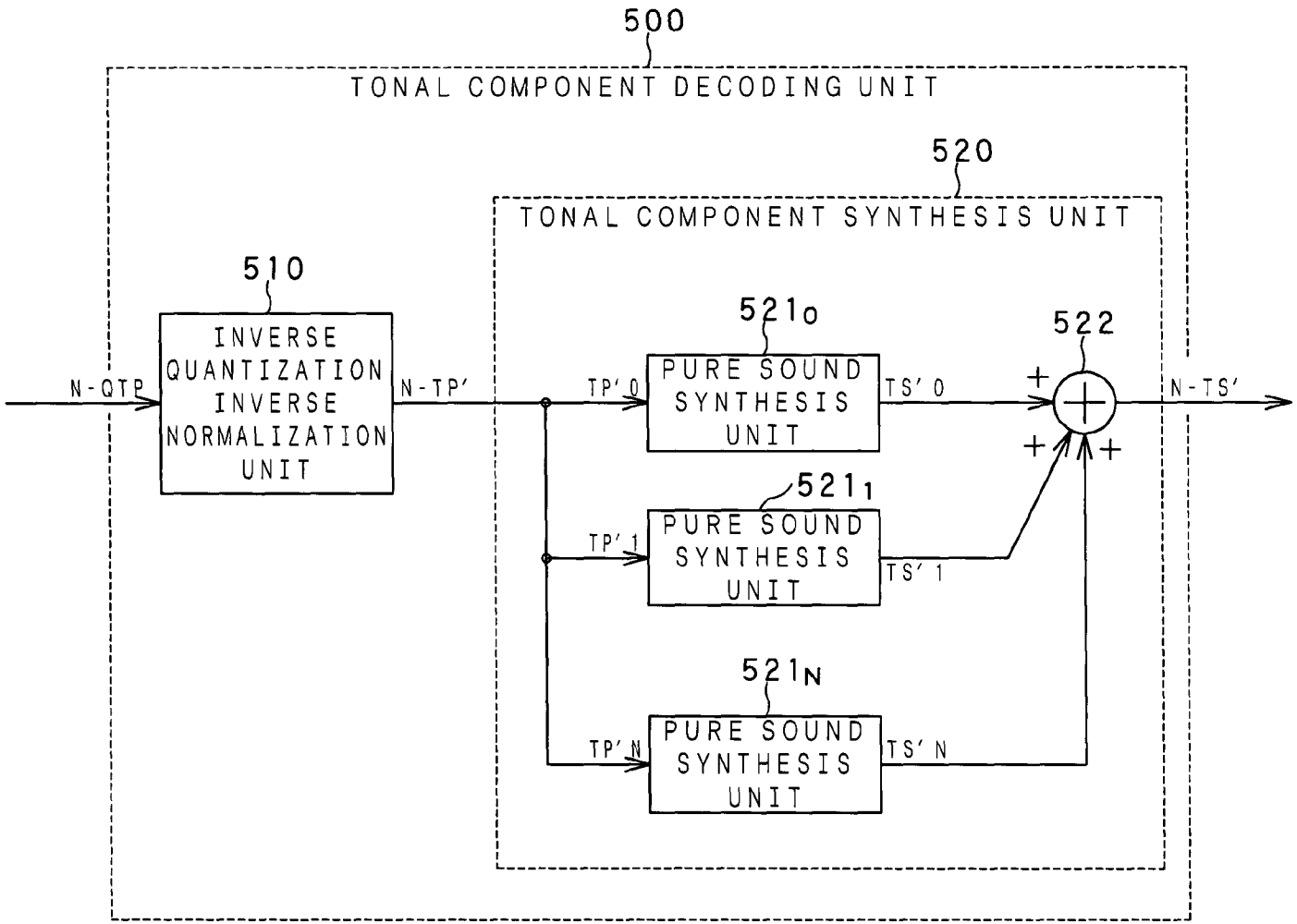
FIG. 12 illustrates a structure of a tonal component decoding unit of the acoustic signal decoding apparatus.

The tonal component decoding unit 420 may specifically be exemplified by a configuration shown for example in FIG. 12, from which it is seem that a tonal component decoding unit 500 includes an inverse quantization inverse normalization unit 510 and a tonal component synthesis unit 520. The inverse quantization inverse normalization unit 510 and the tonal component synthesis unit 520 are equivalent to the inverse quantization inverse normalization unit 421 and the tonal component synthesis unit 422 of FIG. 11, respectively.

In the tonal component decoding unit 500, the inverse quantization inverse normalization unit 510 inverse-quantizes and inverse-normalizes the input tonal component information N-QTP, and routes the pure sound waveform parameters TP'0, TP'2, . . . , TP'N, associated with the respective pure sound waveforms of the tonal component parameters N-TP', to pure sound synthesis units $\mathbf{521}_0$, $\mathbf{521}_1$, . . . , $\mathbf{521}_N$, respectively.

The pure sound synthesis units $\mathbf{521}_0$, $\mathbf{521}_1$, . . . , $\mathbf{521}_N$ synthesize each one of pure sound waveforms TS'0, TS'1, . . . , TS'N, based on pure sound waveform parameters TP'0, TP'1, . . . , TP'N, supplied from the inverse quantization inverse normalization unit 510.

The adder 522 synthesizes the pure sound waveforms TS'0, TS'1, . . . , TS'N, supplied from the pure sound synthesis units $\mathbf{521}_0$, $\mathbf{521}_1$, . . . , $\mathbf{521}_N$ to output the synthesized waveforms as tonal component time-domain signals N-TS'.

The processing by the acoustic signal decoding apparatus 400 in case the tonal component decoding unit 420 of FIG. 11 is configured as shown in FIG. 12 is now explained in detail with reference to the flowchart of FIG. 13.

First, at step S41, a code string, generated by the acoustic signal encoding apparatus 100, is input. At the next step S42, the code string is resolved into the tonal component information and the residual signal information.

At the next step S43, it is checked whether or not there are any tonal component parameters in the resolved code string. If there is any tonal component parameter, processing transfers to step S44 and, if otherwise, processing transfers to step S46.

At step S44, the respective parameters of the tonal components are inverse quantized and inverse normalized to produce respective parameters of the tonal component signals.

At the next step S45, the tonal component waveform is synthesized, in accordance with the parameters obtained at step S44, to generate the tonal component time-domain signals.

At step S46, the residual signal information, obtained at step S42, is inverse-quantized and inverse-normalized to produce a spectrum of the residual time-domain signals.

At the next step S47, the spectral information obtained at step S46, is inverse orthogonal-transformed to generate residual component time-domain signals.

At step S48, the tonal component time-domain signals, generated at step S45, and the residual component time-domain signals, generated at step S47, are summed on the time axis to generate restored time-domain signals, which then are output at step S49.

By the above-described processing, the acoustic signal decoding apparatus 400 of the present embodiment restores the input acoustic time-domain signals.

Figure 13:
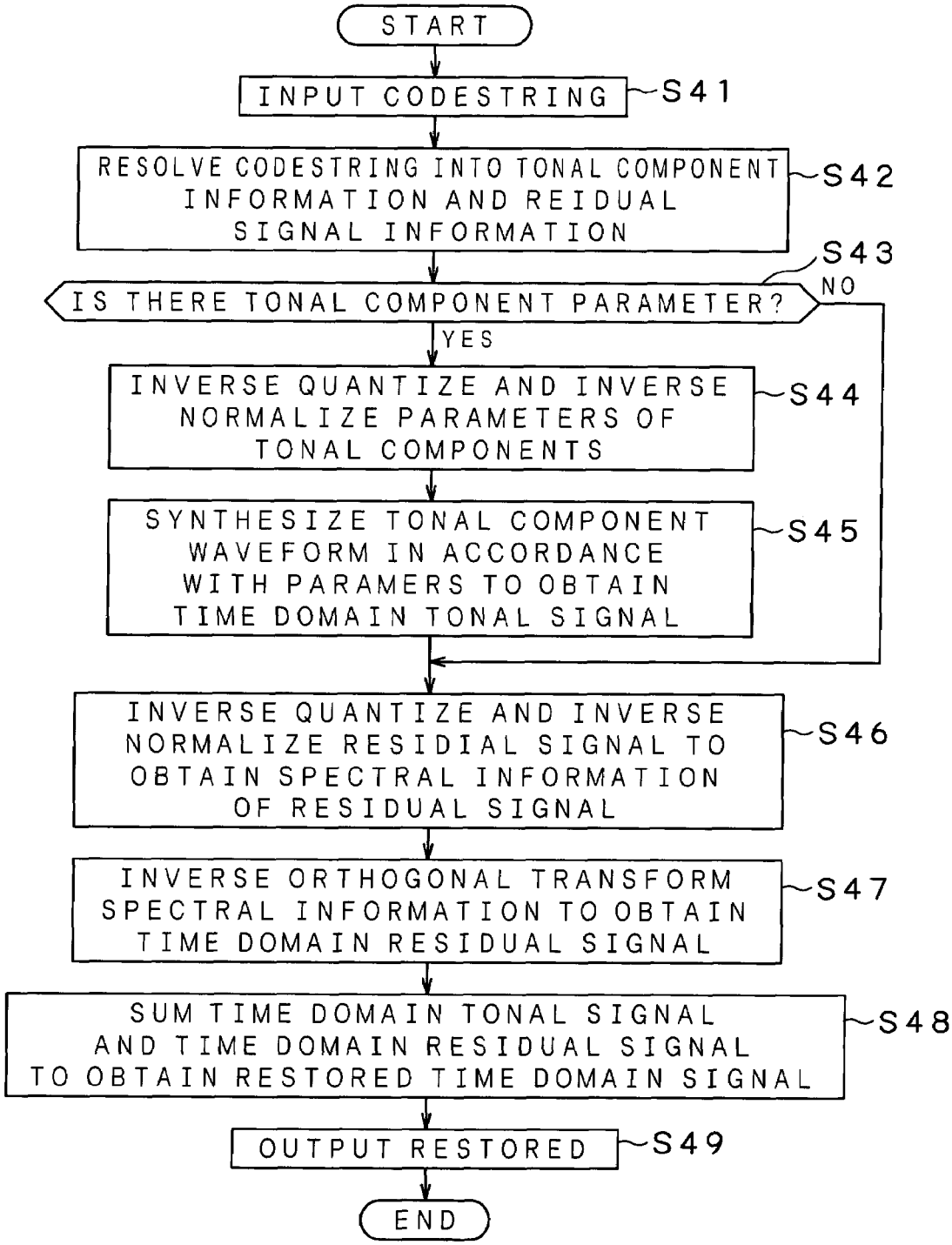
FIG. 13 is a flowchart showing a sequence of operations of the acoustic signal decoding apparatus.

In FIG. 13, it is checked at step S43 whether or not there are any tonal component parameters in the resolved code string. However, processing may directly proceed to step S44 without making such decision. If, in this case, there are no tonal component parameters, 0 is synthesized at step S48 as the tonal component time-domain signal.

Figure 14:
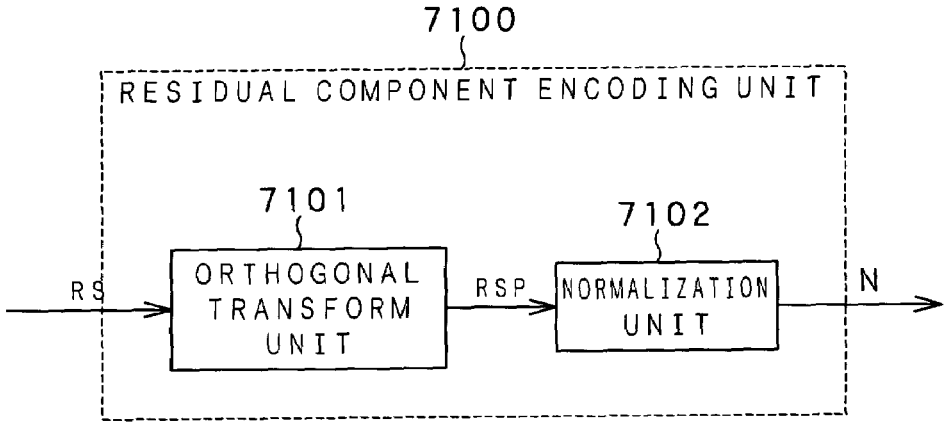
FIG. 14 illustrates another structure of the a residual component encoding unit of the acoustic signal decoding apparatus.

It may be contemplated to substitute the configuration shown in FIG. 14 for the residual component encoding unit 130 shown in FIG. 2. Referring to FIG. 14, a residual component encoding unit 7100 includes an orthogonal transform unit 7101 for transforming the residual time-domain signals RS into the spectral information RSP and a normalization unit 7102 for normalizing the spectral information RSP obtained at the orthogonal transform unit 7101 to output the normalized information N. That is, the residual component encoding unit 7100 only normalizes the spectral information, without quantizing it, and outputs only the normalized information N to the side decoder.

Figure 15:
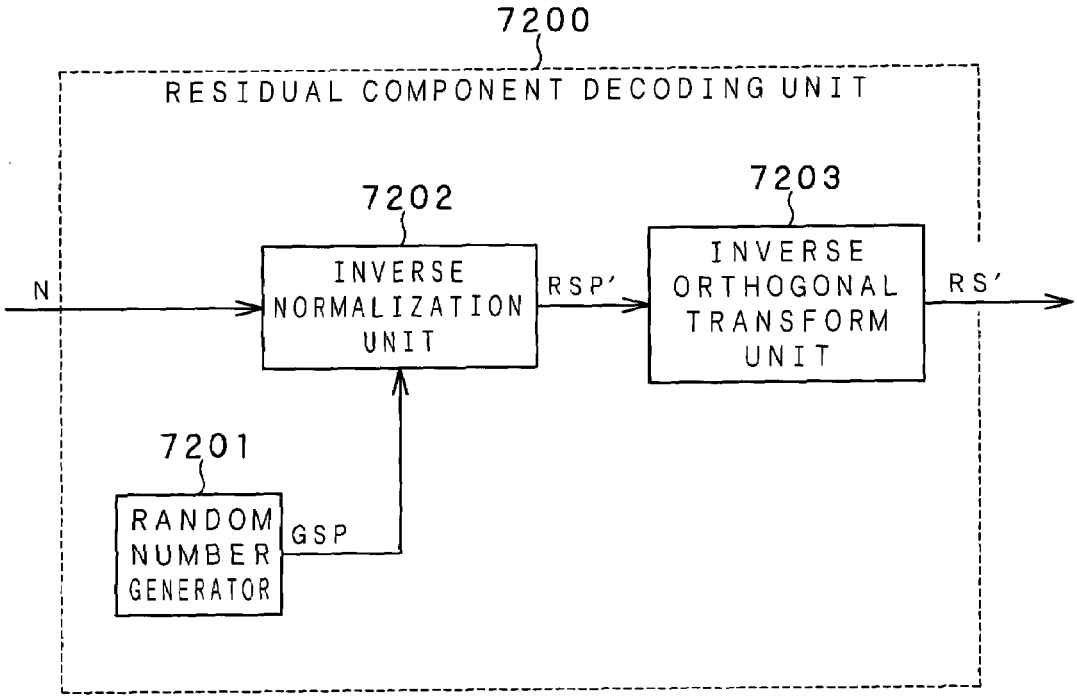
FIG. 15 shows an illustrative structure of a residual signal decoding unit as a counterpart of the residual component encoding unit shown in FIG. 14.

In this case, the decoder is configured as shown in FIG. 15. That is, a residual component decoding unit 7200 includes a random number generator 7201 for generating the pseudo-spectral information GSP by random numbers exhibiting any suitable random number distribution, an inverse normalization unit 7202 for inverse normalization of the pseudo-spectral information GSP generated by the random number generator 7201 in accordance with the normalization information, and an inverse orthogonal transform unit 7203 for inverse orthogonal transforming the pseudo spectral information RSP' inverse-normalized by the inverse normalization unit 7202, which information RSP' is deemed to be the pseudo-spectral information, to generate pseudo residual time-domain signals RS', as shown in FIG. 15.

It is noted that, in generating random numbers in the random number generator 7201, the random number distribution is preferably such a one that is close to the information distribution achieved on orthogonal transforming and normalizing the routine acoustic signals or noisy signals. It is also possible to provide plural random number distributions and to analyze which distribution is optimum at the time of encoding, with the ID information of the optimum distribution then being contained in a code string and random numbers being then generated using the random number distribution of the ID information, referenced at the time of decoding, to generate the more approximate residual time-domain signals.

With the present embodiment, described above, it is possible to extract tonal component signals in the acoustic signal encoding apparatus and to perform efficient encoding on the tonal and residual components, such that, in the acoustic signal decoding apparatus, the encoded code string can be decoded by a method which is a counterpart of a method used by an encoder.

The present invention is not limited to the above-described embodiment. As a second illustrative structure of the encoder and the decoder for the acoustic signal, the acoustic time-domain signals S may be divided into plural frequency ranges, each of which is then processed for encoding and subsequent decoding, followed by synthesis of the frequency ranges. This will now be explained briefly.

Figure 16A:
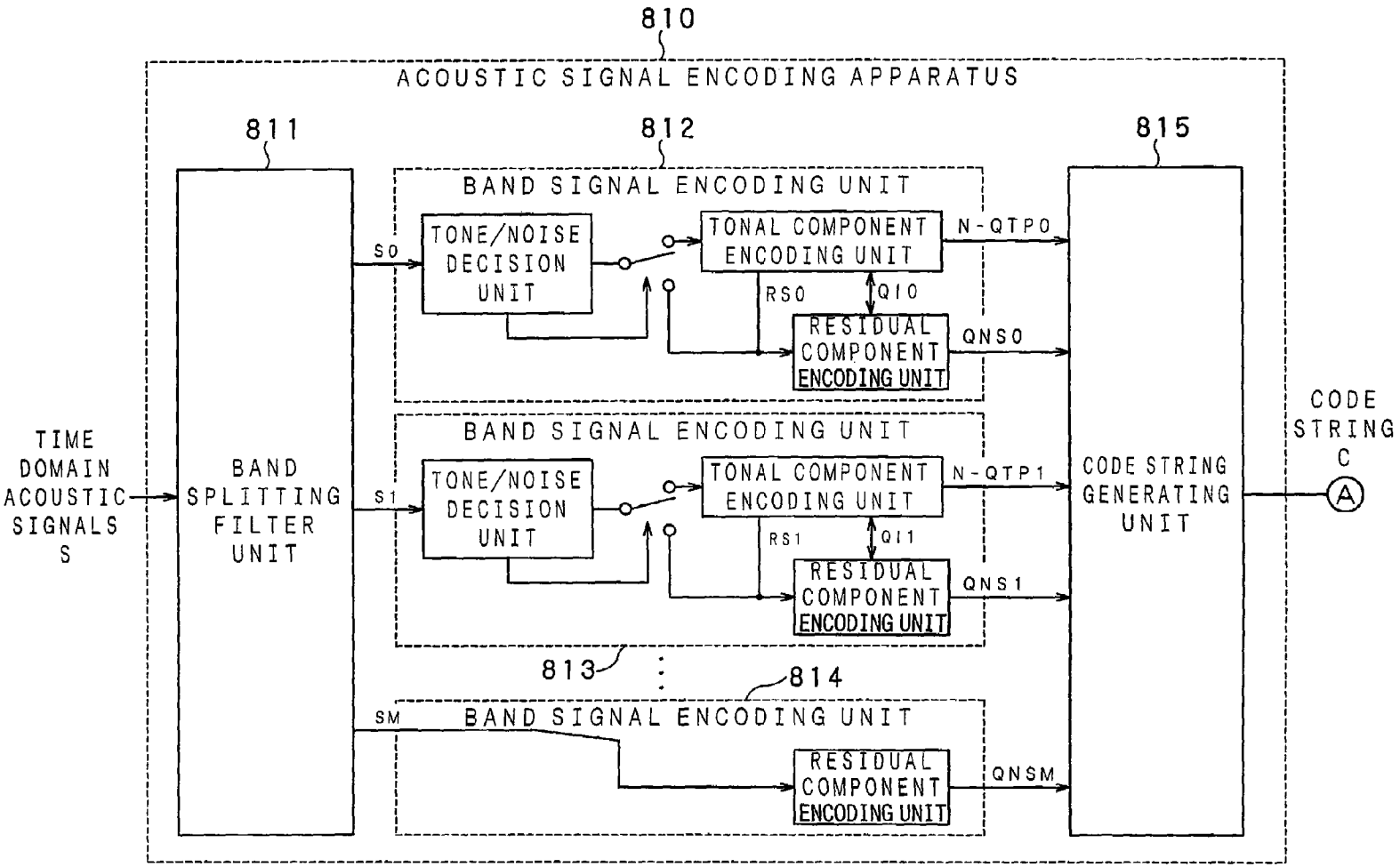
FIG. 16A illustrates a second illustrative structure of the acoustic signal encoding apparatus and the acoustic signal decoding apparatus.
Figure 16B:
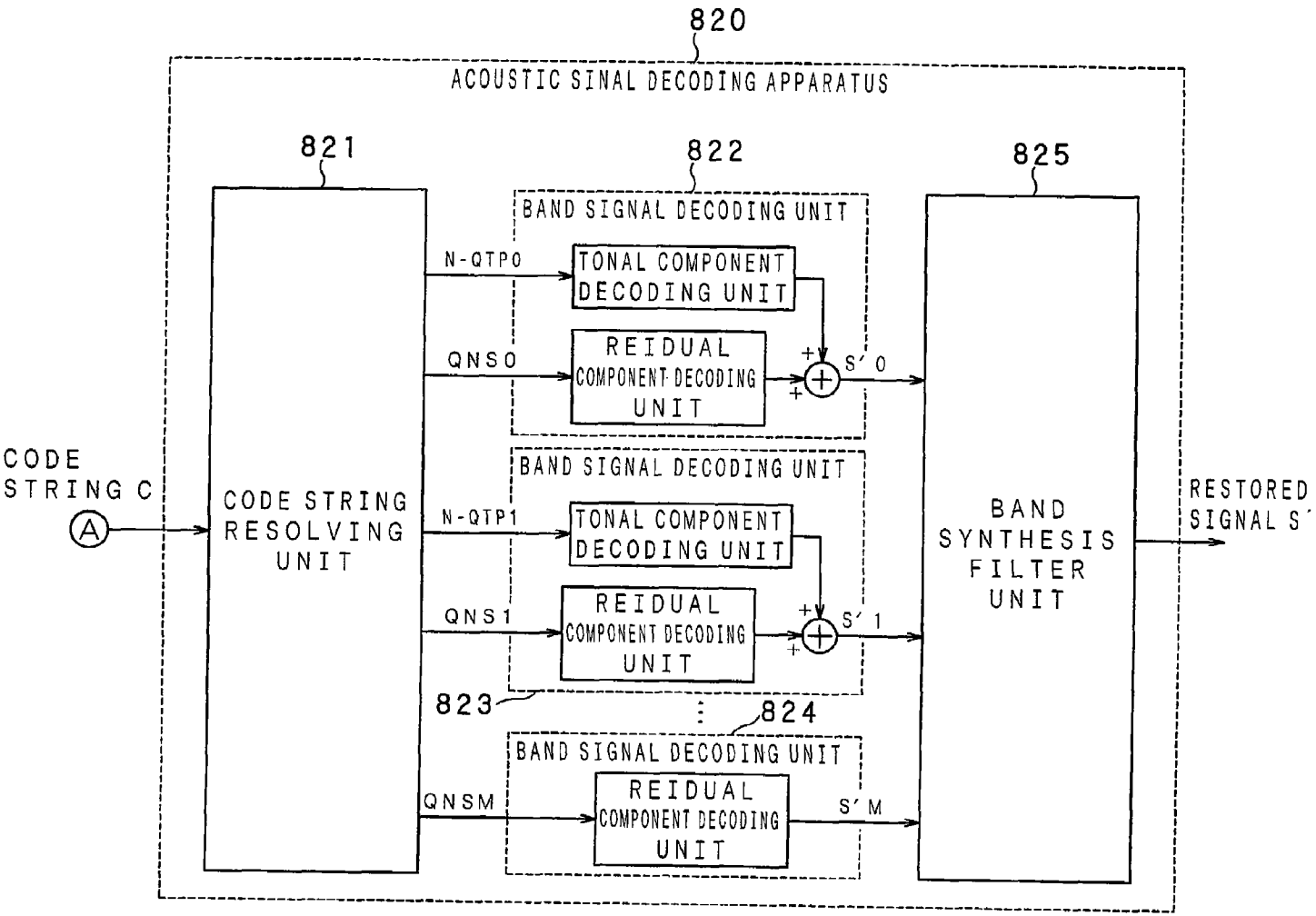
FIG. 16B illustrates a second illustrative structure of the acoustic signal encoding apparatus and the acoustic signal decoding apparatus.

In FIG. 16, an acoustic signal encoding apparatus 810 includes a band splitting filter unit 811 for band splitting the input acoustic time-domain signals S into plural frequency bands, band signal encoding units 812, 813 and 814 for obtaining the tonal component information N-QTP and the residual component information QNS from the input signal band-split into plural frequency bands and a code string generating unit 815 for generating the code string C from the tonal component information N-QTP and/or from the residual component information QNS of the respective bands.

Although the band signal encoding units 812, 813 and 814 are formed by a tonal noise decision unit, a tonal component encoding unit and a residual component encoding unit, the band signal encoding unit may be formed only by the residual component encoding unit for a high frequency band where tonal components exist only in minor quantities, as indicated by the band signal encoding unit 814.

An acoustic signal encoding apparatus 820 includes a code string resolving unit 821, supplied with the code string C generated in the acoustic signal encoding apparatus 810 and resolving the input code string into the tonal component information N-QTP and the residual component information QNS, split on the band basis, band signal decoding units 822, 823 and 824 for generating the time-domain signals for the respective bands from the tonal component information N-QTP and from the residual component information QNS, split on the band basis, and a band synthesis filter unit 825 for band synthesizing the band-based restored signals S' generated in the band signal decoding units 822, 823 and 824.

It is noted that the band signal decoding units 822, 823 and 824 are formed by the above-mentioned tonal component decoding unit, residual component decoding unit and the adder. However, as in the case of the side encoder, the band signal decoding unit may be formed only by the residual component decoding unit for a high frequency band where tonal components exist only in minor quantities.

Figure 17A:
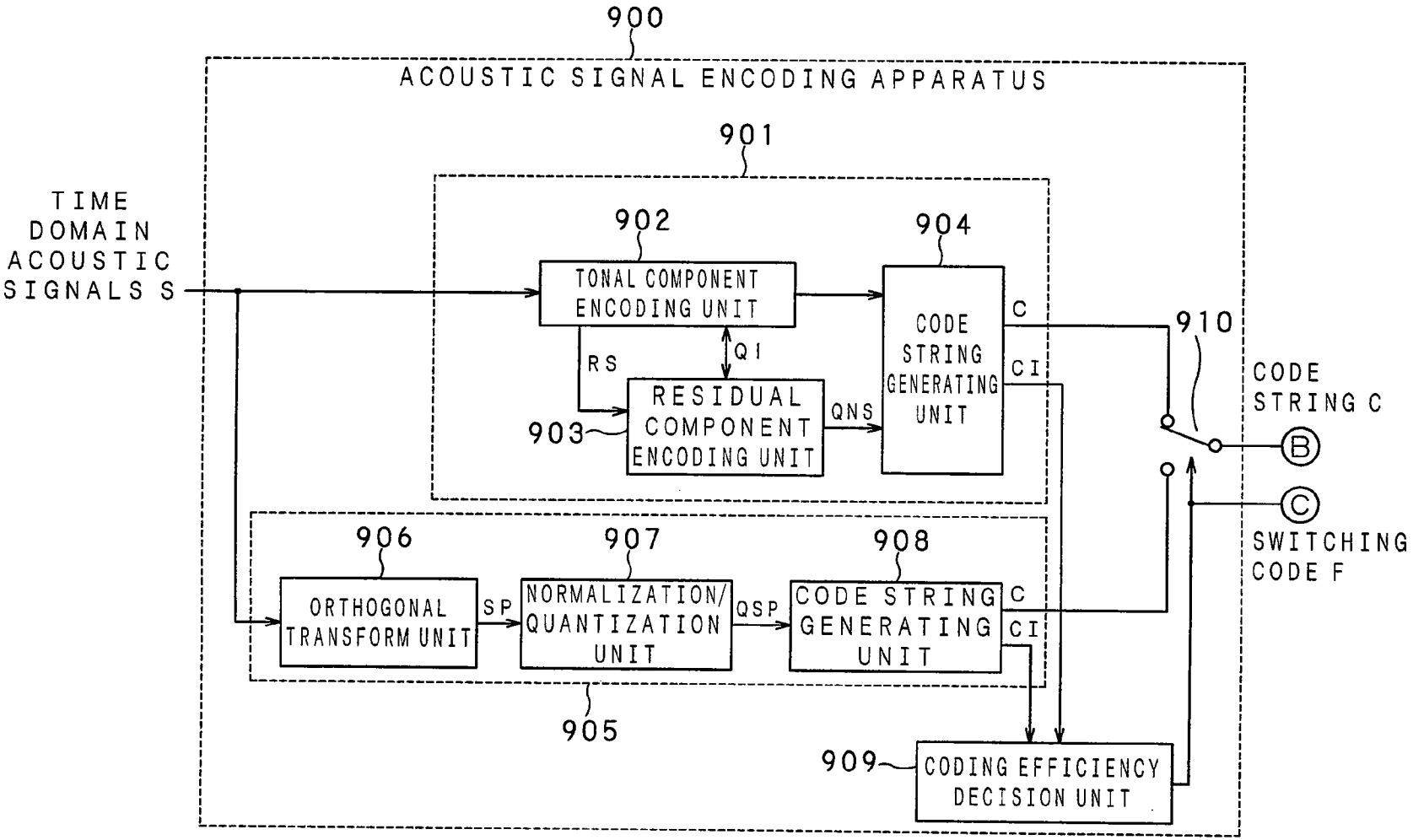
FIG. 17A illustrates a third illustrative structure of the acoustic signal encoding apparatus and the acoustic signal decoding apparatus.
Figure 17B:
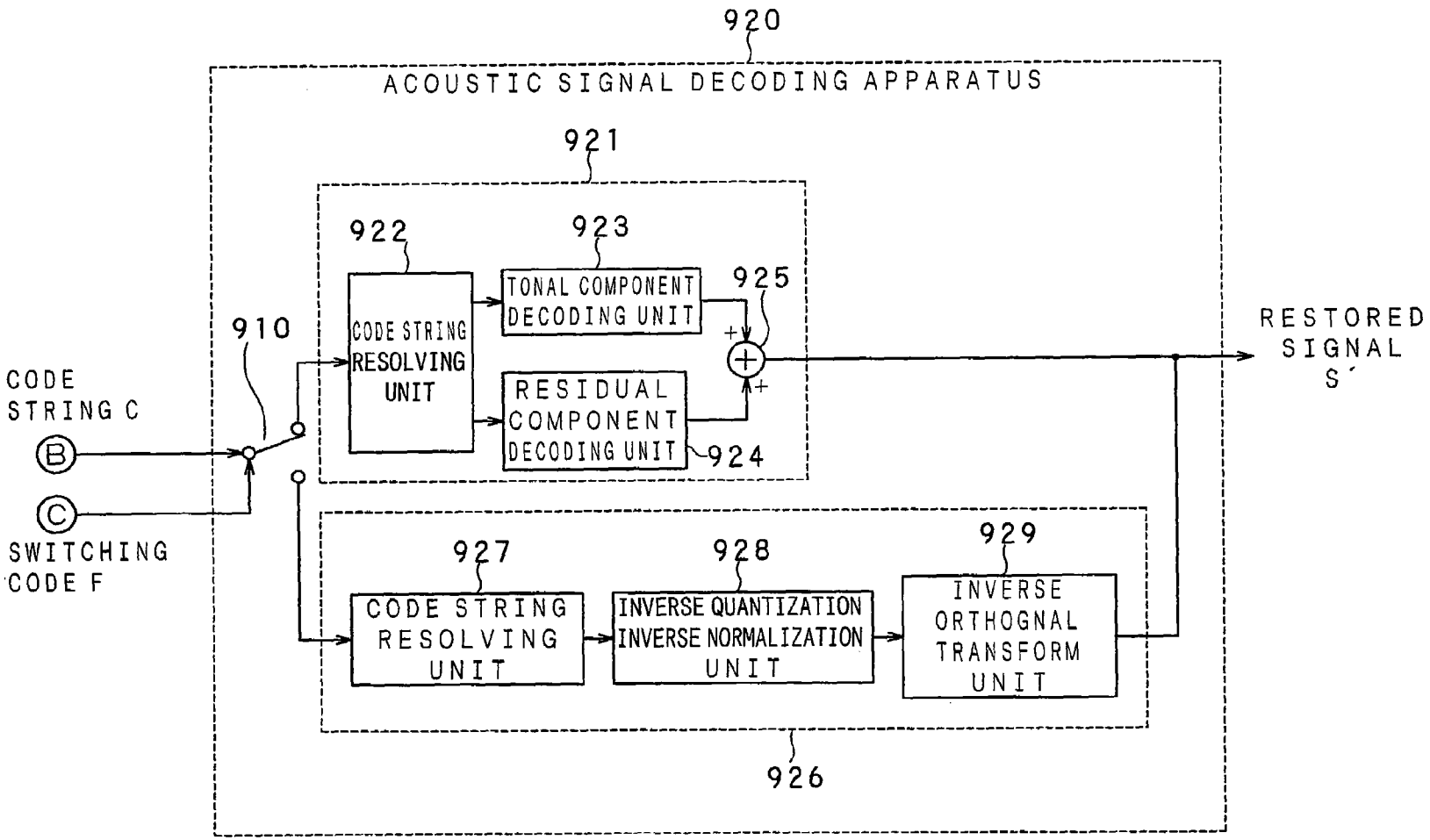
FIG. 17B illustrates a third illustrative structure of the acoustic signal encoding apparatus and the acoustic signal decoding apparatus.

As a third illustrative structure of the acoustic signal encoding device and an acoustic signal decoding device, it may be contemplated to compare the values of the encoding efficiency with plural encoding systems and to select the code string C by the encoding system with a higher coding efficiency, as shown in FIG. 17. This is now explained briefly.

Referring to FIG. 17, an acoustic signal encoding apparatus 900 includes a first encoding unit 901 for encoding the input acoustic time-domain signals S in accordance with the first encoding system, a second encoding unit 905 for encoding the input acoustic time-domain signals S in accordance with the second encoding system and an encoding efficiency decision unit 909 for determining the encoding efficiency of the first encoding system and that of the second encoding system.

The first encoding unit 901 includes a tonal component encoding unit 902, for encoding the tonal component of the acoustic time-domain signals S, a residual component encoding unit 903 for encoding the residual time-domain signals, output from the tonal component encoding unit 902, and a code string generating unit 904 for generating the code string C from the tonal component information N-QTP, residual component information QNS generated in the tonal component encoding unit 902, and the residual component encoding unit 903.

The second encoding unit 905 includes an orthogonal transform unit 906 for transforming the input time-domain signals into the spectral information SP, a normalization/quantization unit 907 for normalizing/quantizing the spectral information SP obtained in the orthogonal transform unit 906 and a code string generating unit 908 for generating the code string C from the quantized spectral information QSP obtained in the normalization/quantization unit 907.

The encoding efficiency decision unit 909 is supplied with the encoding information CI of the code string C generated in the code string generating unit 904 and in the code string generating unit 908. The encoding efficiency decision unit compares the encoding efficiency of the first encoding unit 901 to that of the second encoding unit 905 to select the actually output code string C to control a switching unit 910. The switching unit 910 switches between output code strings C in dependence upon the switching code F supplied from the encoding efficiency decision unit 909. If the code string C of the first encoding unit 901 is selected, the switching unit 910 switches so that the code string will be supplied to a first decoding unit 921, as later explained, whereas, if the code string C of the second encoding unit 905 is selected, the switching unit 910 switches so that the code string will be supplied to the second decoding unit 926, similarly as later explained.

On the other hand, an acoustic signal decoding unit 920 includes a first decoding unit 921 for decoding the input code string C in accordance with the first decoding system, and a second decoding unit 926 for decoding the input code string C in accordance with the second decoding system.

The first decoding unit 921 includes a code string resolving unit 922 for resolving the input code string C into the tonal component information and the residual component information, a tonal component decoding unit 923 for generating the tonal component time-domain signals from the tonal component information obtained in the code string resolving unit 922, a residual component decoding unit 924 for generating the residual component time-domain signals from the residual component information obtained in the code string resolving unit 922 and an adder 925 for synthesizing the tonal component time-domain signals and the residual component time-domain signals generated in the tonal component decoding unit 923 and in the residual component decoding unit 924, respectively.

The second decoding unit 926 includes a code string resolving unit 927 for obtaining the quantized spectral information from the input code string C, an inverse quantization inverse normalization unit 928 for inverse quantizing and inverse normalizing the quantized spectral information obtained in the code string resolving unit 927 and an inverse orthogonal transform unit 929 for inverse orthogonal transforming the spectral information obtained by the inverse quantization inverse normalization unit 928 to generate time-domain signals.

That is, the acoustic signal decoding unit 920 decodes the input code string C in accordance with the decoding system which is the counterpart of the encoding system selected in the acoustic signal encoding apparatus 900.

It should be noted that a large variety of modifications other than the above-mentioned second and third illustrative structures can be envisaged within the scope of the present invention.

In the above-described embodiment, MDCT is mainly used for orthogonal transform. This is merely illustrative, such that FFT, DFT or DCT may also be used. The frame-to-frame overlap is also not limited to one-half frame.

In addition, although the foregoing explanation has been made in terms of the hardware, it is also possible to furnish a recording medium having recorded thereon a program stating the above-described encoding and decoding methods. It is moreover possible to furnish the recording medium having recorded thereon the code string derived therefrom or signals obtained on decoding the code string.

INDUSTRIAL APPLICABILITY

According to the present invention, described above, it is possible to suppress the spectrum from spreading to deteriorate the encoding efficiency, due to tonal components produced in localized frequency, by extracting the tonal component signals from the acoustic signal time-domain signals, and by encoding the tonal component signals and the residual time-domain signals obtained on extracting tonal component signals from the acoustic signal.

The invention claimed is:

1. An acoustic signal encoding method for encoding acoustic time-domain signals comprising:

a tonal/noisy determining step of determining whether said acoustic time-domain signals are tonal or noisy;

a tonal component encoding step of extracting tonal component signals from said acoustic time-domain signals when said acoustic time-domain signals are determined to be tonal and encoding the so extracted tonal component signals, each of said tonal component signals is a pure sound waveform; and a residual component encoding step of encoding residual time-domain signals obtained on extracting said tonal component signals from said acoustic time-domain signals by said tonal component encoding step.

2. The acoustic signal encoding method as recited in claim 1 wherein if encoding units for encoding said acoustic time-domain signals overlap with each other on the time axis, a signal resulting from synthesizing said tonal component signals obtained in a temporally previous encoding unit to said tonal component signals obtained in a temporally posterior encoding unit containing said overlapping portion is extracted from said acoustic time-domain signals in said overlapping portion to obtain said residual time-domain signals.

3. The acoustic signal encoding method as recited in claim 1 further comprising:

a time domain holding step of holding an input to said residual component encoding step.

4. The acoustic signal encoding method as recited in claim 1 wherein said tonal component encoding step includes:

a pure sound analyzing sub-step of analyzing the pure sound waveform which minimizes the residual energy from said acoustic time-domain signals;

a pure sound synthesizing sub-step of synthesizing the pure sound waveform using parameters of the pure sound waveform obtained by said pure sound analyzing sub-step;

a subtracting sub-step of sequentially subtracting the pure sound waveform synthesized by said pure sound synthesizing sub-step from said acoustic time-domain signals to produce residual signals;

an end condition decision sub-step of analyzing said residual signals obtained by said subtracting step to verify the end of the pure sound analyzing sub-step based on a preset condition; and a normalization/quantization sub-step of normalizing and quantizing parameters of the pure sound waveform obtained by said pure sound analyzing sub-step.

5. The acoustic signal encoding method as recited in claim 4 further comprising:

an extracted waveform synthesizing sub-step of synthesizing, in case the encoding units used in encoding said acoustic time-domain signals overlap on the time axis, said tonal component signals obtained in a temporally previous encoding unit to said tonal component signals obtained in a temporally posterior encoding unit in an overlapping portion to generate synthesized signals; and a subtracting outputting sub-step of subtracting said synthesized signals from said acoustic time-domain signals to output said residual time-domain signals.

6. The acoustic signal encoding method as recited in claim 1 wherein said tonal component encoding step includes:

a pure sound analyzing sub-step of analyzing the pure sound waveform which minimizes the residual energy from the acoustic time-domain signals; a normalization/quantization sub-step of normalizing and quantizing parameters of the pure sound waveform obtained by said pure sound analyzing sub-step;

an inverse quantization/inverse normalization sub-step of inverse quantizing and inverse normalizing parameters of the pure sound waveform obtained by said normalization/quantization sub-step;

a pure sound waveform synthesizing sub-step of synthesizing the pure sound waveform using the parameters of the pure sound waveform obtained by said inverse quantization/inverse normalization sub-step;

a subtracting sub-step of sequentially subtracting the pure sound waveform synthesized by said pure sound synthesis step from said acoustic time-domain signals to obtain residual signals; and an end condition decision sub-step of analyzing said residual signals obtained by said subtracting sub-step to decide on the end of said pure sound analyzing sub-step based on a preset condition.

7. The acoustic signal encoding method as recited in claim 6 further comprising:

an extracted waveform synthesizing sub-step of synthesizing, in case the encoding units used in encoding said acoustic time-domain signals overlap on the time axis, said tonal component signals obtained in a temporally previous encoding unit to said tonal component signals obtained in a temporally posterior encoding unit in an overlapping portion to generate synthesized signals; and a subtracting outputting sub-step of subtracting said synthesized signals from said acoustic time-domain signals to output said residual time-domain signals.

8. The acoustic signal encoding method as recited in claim 1 wherein said tonal component encoding step includes:

a pure sound analyzing sub-step of analyzing the pure sound waveform which minimizes the residual energy from said acoustic time-domain signals;

a pure sound synthesizing step of synthesizing the pure sound waveform obtained by said pure sound analyzing sub-step;

a subtracting sub-step of sequentially subtracting the pure sound waveform synthesized by said pure sound synthesizing sub-step from said acoustic time-domain signals to produce residual signals;

an end condition decision sub-step of analyzing said residual signals obtained by said subtracting step to verify the end of the pure sound analyzing sub-step based on a preset condition;

a normalization/quantization sub-step of normalizing and quantizing parameters of the pure sound waveform obtained by said pure sound analyzing sub-step; and an inverse quantization/normalization sub-step of inverse quantizing and inverse normalizing the parameters of the pure sound waveform obtained by said normalization/quantization sub-step.

9. The acoustic signal encoding method as recited in claim 8 further comprising:

an extracted waveform synthesizing sub-step of synthesizing an extracted waveform by synthesizing, in case the encoding units used in encoding said acoustic time-domain signals overlap on the time axis, said tonal component signals obtained in a temporally previous encoding unit to said tonal component signals obtained in a temporally posterior encoding unit in an overlapping portion to generate synthesized signals; and a subtracting outputting sub-step of subtracting said synthesized signals from said acoustic time-domain signals to output said residual time-domain signals.

10. The acoustic signal encoding method as recited in claim 4 wherein the end condition in said end condition decision sub-step is a decision that said residual signals are noisy signals.

11. The acoustic signal encoding method as recited in claim 4 wherein the end condition in said end condition decision sub-step is the energy of said residual signals becoming lower than the energy of the input signal by not less than a preset value.

12. The acoustic signal encoding method as recited in claim 4 wherein the end condition in said end condition decision sub-step is the decreasing energy of said residual signals being not larger than a preset value.

13. The acoustic signal encoding method as recited in claim 1 wherein said residual component encoding step includes:

an orthogonal transforming sub-step of generating and orthogonal transforming residual time-domain signals of one encoding unit from residual time-domain signals in a portion of a previous encoding unit and residual time-domain signals in a portion of a posterior encoding unit; and a normalization/quantization sub-step of normalizing and quantizing the spectral information obtained by said orthogonal transform sub-step.

14. The acoustic signal encoding method as recited in claim 13 wherein the tonal component information obtained by the normalization/quantization sub-step of said tonal component encoding step is compared to the residual component information obtained by the normalization/quantization sub-step of said residual component encoding step and, lacking matching, the quantization step of said tonal component information is changed and analysis and extraction of the tonal components are again carried out.

15. The acoustic signal encoding method as recited in claim 1 wherein said residual component encoding step includes:

an orthogonal transforming sub-step of generating residual signals of an encoding unit by residual time-domain signals of a portion of a temporally previous encoding unit and by residual time-domain signals of a portion of a temporally posterior encoding unit and orthogonal transforming said residual signals; and a normalization sub-step of normalizing the spectral information obtained in said orthogonal transforming sub-step.

16. An acoustic signal decoding method for decoding acoustic signals in which tonal component signals are extracted from acoustic time-domain signals determined to be tonal and encoded and in which a code string obtained on encoding residual time-domain signals corresponding to said acoustic time-domain signals freed on extraction of said tonal component signals is input and decoded, each of said tonal components signals is a pure sound waveform, said method comprising:

a code string resolving step of resolving said code string;

a tonal component decoding step of decoding the tonal component time-domain signals in accordance with the tonal component information obtained by said code string resolving step;

a residual component decoding step of decoding residual component time-domain signals in accordance with the residual component information obtained by said code string resolving step; and a summation step of summing the tonal component time-domain signals obtained by said tonal component decoding step to the residual component time-domain signals obtained by said residual component decoding step to restore said acoustic time-domain signals.

17. The acoustic signal decoding method as recited in claim 16 wherein said tonal component decoding step includes:

an inverse quantization/inverse normalization sub-step of inverse quantizing and inverse normalizing the tonal component information obtained by said code string resolving step; and a tonal component synthesizing sub-step of synthesizing the tonal component time-domain signals in accordance with the tonal component information obtained by said inverse quantization/inverse normalization sub-step.

18. The acoustic signal decoding method as recited in claim 16 wherein said residual component decoding step includes:

an inverse quantization/inverse normalization sub-step of inverse quantizing and inverse normalizing the residual component information obtained by said code string resolving step; and an inverse orthogonal transform sub-step of inverse orthogonal transforming the residual component spectral information by said inverse quantization/inverse normalization sub-step to generate residual component time-domain signals.

19. The acoustic signal decoding method as recited in claim 17 wherein said tonal component synthesizing sub-step includes:

a pure sound waveform synthesizing sub-step of synthesizing the pure sound waveform in accordance with said tonal component information obtained by said inverse quantization/inverse normalization sub-step; and a summation sub-step of summing a plurality of said pure sound waveforms obtained by said pure sound waveform synthesizing sub-step to synthesize said tonal component time-domain signals.

20. The acoustic signal decoding method as recited in claim 16 wherein said residual component information is obtained by generating residual time-domain signals of one encoding unit from residual time-domain signals in a portion of a temporally previous encoding unit and from residual time-domain signals in a portion of a temporally previous encoding unit, orthogonal transforming the residual time-domain signals of one encoding unit and by normalizing the resulting spectral information; and wherein said residual component decoding step includes:

a random number generating sub-step of generating random numbers;

an inverse normalizing sub-step of inverse normalizing said random numbers in accordance with the normalizing information obtained by said normalization on the side encoder to generate the pseudo-spectral information; and an inverse orthogonal transform sub-step of inverse orthogonal transforming said pseudo-spectral information obtained by said inverse-normalizing sub-step to generate pseudo residual component time-domain signals.

21. The acoustic signal decoding method as recited in claim 20 wherein said random number generating sub-step generates, as random numbers, such random numbers having a distribution close to distribution obtained on orthogonal transforming and normalizing general acoustic time-domain signals or noisy signals.

22. The acoustic signal decoding method as recited in claim 20 wherein the code string has such ID information showing distribution selected on the side encoder as being close to the distribution of the normalized spectral information, and wherein, in said random number generating sub-step, said random numbers of a distribution which is based on said ID information are generated.

23. An acoustic signal encoding method for encoding acoustic time-domain signals comprising:

a frequency band splitting step of splitting said acoustic time-domain signals into a plurality of frequency bands;

a tonal/noisy determining step of determining whether said acoustic time-domain signals are tonal or noisy for at least one frequency band;

a tonal component encoding step of extracting tonal component signals from said acoustic time-domain signals of the at least one frequency band when said acoustic time-domain signals are determined to be tonal and encoding the so extracted tonal component signals, each of said tonal component signals is a pure sound waveform; and a residual component encoding step of encoding residual time-domain signals freed on extraction of said tonal component signals by said tonal component encoding step from said acoustic time-domain signals of at least one frequency range.

24. An acoustic signal decoding method in which acoustic time-domain signals are split into a plurality of frequency bands, tonal component signals are extracted from said acoustic time-domain signals determined to be tonal in at least one frequency band and encoded, each of said tonal component signals is a pure sound waveform, a code string obtained on encoding residual time-domain signals obtained in turn on extracting said tonal component signals from said acoustic time-domain signals of at least one frequency band is input, and in which the so input code string is decoded, said method comprising:

a code string resolving step of resolving said code string;

a tonal component decoding step of synthesizing, for said at least one frequency band, tonal component time-domain signals in accordance with the residual component information obtained by said code string resolving step;

a residual component decoding step of generating, for said at least one frequency band, residual component time-domain signals in accordance with the residual component information obtained by said code string resolving step;

a summation step of summing the tonal component time-domain signals obtained by said tonal component decoding step to the residual component time-domain signals obtained by said residual component decoding step; and a band synthesizing step of band-synthesizing decoded signals for each band to restore said acoustic time-domain signals.

25. An acoustic signal encoding method for encoding acoustic signals comprising:

a first acoustic signal encoding step of encoding said acoustic time-domain signals using a first encoding method including:

a tonal/noisy determining step of determining whether said acoustic time-domain signals are tonal or noisy;

a tonal component encoding step of extracting tonal component signals from said acoustic time-domain signals when said acoustic time-domain signals are determined to be tonal, and encoding said tonal component signals, each of said tonal component signals is a pure sound waveform;

a residual component encoding step of encoding residual time-domain signals obtained on extracting said tonal component signals from said acoustic time-domain signals by said tonal component encoding step;

a code string generating step of generating a code string from the information obtained by said tonal component encoding step and the information obtained from the residual component encoding step;

a second acoustic signal encoding step of encoding said acoustic time-domain signals by a second encoding method; and an encoding efficiency decision step of comparing the encoding efficiency of said first acoustic signal encoding step to that of said second acoustic signal encoding step to select a code string with a better encoding efficiency.

26. The acoustic signal encoding method as recited in claim 25 wherein said second acoustic signal encoding step includes:

an orthogonal transforming sub-step of orthogonal transforming said acoustic time-domain signals;

a normalization/quantization sub-step of normalizing and quantizing the spectral information obtained by said orthogonal transforming sub-step; and a code string generating sub-step of generating a code string from the information obtained by said normalization/quantization sub-step.

27. An acoustic signal decoding method for decoding a code string, the method comprising:

selectively inputting and decoding a code string encoded by a first acoustic signal encoding step or a code string encoded by a second acoustic signal encoding step, whichever is higher in encoding efficiency, wherein, said first acoustic signal encoding step being such a step in which the acoustic signals are encoded by a first encoding method comprising:

generating a code string from the information obtained by determining whether said acoustic time-domain signals are tonal or noisy, by extracting tonal component signals from said acoustic time-domain signals determined to be tonal and on encoding the tonal component signals and from the information obtained by encoding residual signals obtained in turn by extracting said tonal component signals from said acoustic time-domain signals, each of said tonal component signals is a pure sound waveform;

said second acoustic signal encoding step being such a step in which the acoustic time domain signals are encoded by a second encoding method;

if the code string resulting from encoding in said first acoustic signal encoding step is input, said acoustic time-domain signals are restored by a first acoustic signal decoding step including a code string resolving step of resolving said code string into the tonal component information and the residual component information, a tonal component decoding step of generating the tonal component time-domain signals in accordance with the tonal component information obtained in said code string resolving step, a residual component decoding step of generating residual component time-domain signals in accordance with said residual component information obtained in said code string resolving step and a summation step of summing said tonal component time-domain signals to said residual component time-domain signals; and if the code string obtained on encoding in said second acoustic signal encoding step is input, said acoustic time-domain signals are restored by a second acoustic signal decoding sub-step corresponding to said second acoustic signal encoding step.

28. The acoustic signal decoding method as recited in claim 27, wherein:

said second acoustic signal encoding step generates the code string from the information normalized and quantized from the spectral information obtained on orthogonal transforming said acoustic time-domain signals; and said second acoustic signal decoding step includes:

a code string resolving step of resolving said code string to produce the quantized spectral information;

an inverse quantization/inverse normalization sub-step of inverse quantizing and inverse normalizing said quantized spectral information; and an inverse orthogonal transforming the spectral information obtained by said inverse quantization/inverse normalization sub-step.

29. An acoustic signal encoding apparatus for encoding acoustic time-domain signals comprising:

a tonal/noisy determining unit for determining whether said acoustic time-domain signals are tonal or noisy;

a tonal component encoding unit for extracting tonal component signals from said time-domain signals when said acoustic time-domain signals are determined to be tonal and encoding the so extracted signals, each of said tonal component signals being a pure sound waveform; and a residual component encoding unit of encoding residual time-domain signals, freed on extraction said tonal component information from said acoustic time-domain signals by said tonal component encoding unit.

30. An acoustic signal decoding apparatus in which a code string resulting from determining whether acoustic time-domain signals are tonal or noisy, extracting tonal component signals from said acoustic time-domain signals when said acoustic time-domain signals are determined to be tonal, each of said tonal component signals is a pure sound waveform, encoding said tonal component signals and from encoding residual time-domain signals corresponding to said acoustic time-domain signals freed on extraction of said tonal component signals, is input and decoded, said apparatus including:

a code string resolving unit for resolving said code string;

a tonal component decoding unit for decoding the tonal component time-domain signals in accordance with the tonal component information obtained by said code string resolving unit;

a residual component decoding unit for decoding the residual time-domain signals in accordance with the residual component information obtained by said code string resolving unit; and a summation unit for summing the tonal component time-domain signals obtained from said tonal component decoding means and the residual component time-domain signals obtained from said residual component decoding unit to restore said acoustic time-domain signals.

31. A computer-controllable recording medium having recorded thereon an acoustic signal encoding program configured for encoding acoustic time-domain signals, wherein said acoustic signal encoding program includes:

a tonal/noisy determining step of determining whether said acoustic time-domain signals are tonal or noisy;

a tonal component encoding step of extracting tonal component signals from said acoustic time-domain signals when said acoustic time-domain signals are determined to be tonal and encoding the so extracted tonal component signals, each of said tonal component signals is a pure sound waveform; and a residual component encoding step of encoding residual time-domain signals freed on extracting said tonal component signals from said acoustic time-domain signals by said tonal component encoding step.

32. A computer-controllable recording medium having recorded thereon an acoustic signal encoding program of encoding acoustic time-domain signals determined to be tonal, said acoustic signal encoding program includes:

a code string resolving step of resolving said code string;

a tonal component decoding step of decoding the tonal component time-domain signals in accordance with the tonal component information obtained by said code string resolving step each of said tonal component time-domain signals is a pure sound waveform;

a residual component decoding step of decoding the residual time-domain signals in accordance with the residual component information obtained by said code string resolving step; and a summation step of summing the tonal component time-domain signals obtained from said tonal component decoding step and the residual component time-domain signals obtained from said residual component decoding step to restore said acoustic time-domain signals.

33. A recording medium having recorded thereon a code string obtained form the method comprising the steps of:

determining whether acoustic time-domain signals are tonal rather than noisy;

extracting tonal component signals from said acoustic time-domain signals when said acoustic time-domain signals are determined to be tonal time-domain, each of said tonal component time-domain signals is a pure sound waveform;

encoding the tonal component signals; and encoding said residual time-domain signals corresponding to said acoustic time-domain signals freed on extraction of said tonal component signals from the acoustic time-domain signals.

* * * * *